United States Patent [19]

Ikeda et al.

[11] Patent Number: 4,582,786

[45] Date of Patent: Apr. 15, 1986

[54] SILVER HALIDE PHOTOGRAPHIC EMULSION

[75] Inventors: Tadashi Ikeda, Kanagawa; Haruo Takei, Shizuoka; Hiroshi Yamashita, Kanagawa, all of Japan

[73] Assignee: Fuji Photo Film Co., Ltd., Kanagawa, Japan

[21] Appl. No.: 676,153

[22] Filed: Nov. 29, 1984

[30] Foreign Application Priority Data

Nov. 30, 1983 [JP] · Japan ..... 58-226498

[51] Int. Cl.[4] ..... G03C 1/02; G03C 1/28; G03C 1/34

[52] U.S. Cl. ..... 430/577; 430/567; 430/572; 430/576; 430/615

[58] Field of Search ..... 430/569, 572, 576, 577, 430/567, 615

[56] References Cited

U.S. PATENT DOCUMENTS

| | | | |
|---|---|---|---|
| 3,672,898 | 6/1972 | Schwan et al. | 430/507 |
| 4,414,310 | 11/1983 | Daubendiek et al. | 430/569 |
| 4,433,048 | 2/1984 | Solberg et al. | 430/434 |
| 4,490,458 | 12/1984 | House | 430/569 |

*Primary Examiner*—Mary F. Downey
*Attorney, Agent, or Firm*—Sughrue, Mion, Zinn, Macpeak, and Seas

[57] ABSTRACT

A silver halide photographic emulsion in which tabular silver halide grains having a diameter-to-thickness ratio of 5 or more account for 50% or more of the whole silver halide grains in terms of projected area, said silver halide emulsion containing at least one cyanine dye represented by the following general formula (I) and at least one compound represented by the following general formula (II) and/or at least one compound represented by the following general formula (III):

(I)

(II)

(III)

wherein the substituents are as defined in the claims. The silver halide photographic emulsion is an extremely sensitive, spectrally sensitized emulsion.

26 Claims, No Drawings

SILVER HALIDE PHOTOGRAPHIC EMULSION

FIELD OF THE INVENTION

This invention relates to a silver halide photographic emulsion containing supersensitized tabular silver halide grains.

BACKGROUND OF THE INVENTION

The spectrally sensitizing technique is an extremely important and necessary technique for producing light-sensitive materials having high sensitivity and excellent color reproducibility. Various spectrally sensitizing agents have so far been developed, and many techniques with respect to their use such as supersensitization and the manner of their addition have also been developed. Spectrally sensitizing agents absorb even light rays of a longer wavelength region which a silver halide photographic emulsion does not substantially absorb and in turn transfers the absorbed light energy to silver halide. Therefore, the increase of the amount of trapped light caused by the spectrally sensitizing agent serves to enhance photographic sensitivity. Thus, attempts have been made to increase the amount of the spectrally sensitizing agent to be added to a silver halide emulsion as well as to develop spectrally sensitizing agents with a high light-absorbing coefficient. However, as to the amount of the spectrally sensitizing agent added to a silver halide emulsion, there exists an optimal range, which is usually less than the amount necessary for coating the whole surface of silver halide crystals with it. If the spectrally sensitizing agent is added in an amount more than the above-described optimal range, there results serious desensitization (Mees; *The Theory of the Photographic Process,* pp. 1067–1069 (1942)).

In an effort to increase the amount of spectral sensitizing agent to silver halide, attempts have been made to absorb two spectrally sensitizing agents, which are in a proper electric potential relation with each other, onto silver halide crystals in layer form to thereby increase the amount of trapped light while depressing desensitization which accompanies the increase in the amount of spectrally sensitizing agent added, as described in, for example, Thomas L. Penner & P. B. Gilman, Jr., *Phot. Sci. Eng.,* 20 (3), 97–106 (1976). However, this technique is ineffective for high performance silver halide emulsions with enough high sensitivity to be used in photographic materials and is far from serving to provide actual photographic light-sensitive materials.

Attempts have also been made to cover silver halide crystals with a spectrally sensitizing agent at a coverage within the optimal region in which no desensitization takes place and yet to increase the whole amount of added spectrally sensitizing agent within the optimal region to thereby increase the amount of trapped light and improve spectral sensitivity. An example of this technique is to use tabular silver halide grains having a large specific surface area as described in Japanese Patent Application (OPI) No. 113926/83, etc. In this technique, however, the optimal coverage of the spectrally sensitizing agent in spectral sensitization tends to be considerably lower than that of other silver halide grains such as cubic grains, regular octahedral grains, tetradecahedral grains, twin grains, etc., and hence the amount of spectrally sensitizing agent cannot be increased much. If the amount of a spectrally sensitizing agent is increased, a reduction in sensitivity results, and high spectral sensitivity will not be obtained. Thus, the aforesaid effects of this technique are not necessarily obtained.

Since tabular silver halide emulsions have a low light absorption coefficient and an extremely low sensitivity in the silver halide-intrinsic absorption region due to their small grain volume, high sensitivity is obtained only when the spectrally sensitizing ratio is much higher than that of other forms of silver halide grains. In view of this, the aforesaid effects cannot be great advantages. However, if high sensitivity is obtained by attaining a high spectrally sensitizing ratio, tabular silver halide grains can produce improvement in the sharpness of the image when used in green-sensitive or red-sensitive emulsions of color light-sensitive materials. This is because tabular silver halide grains can allow the elimination of, or a decrease in the thickness of, a yellow filter layer used for lowering blue sensitivity as the tabular silver halide grains have low blue sensitivity which is essentially unnecessary. In many cases, this yellow filter layer is formed by using colloidal silver, and this colloidal silver can diffuse into contiguous emulsion layers to cause fog. This problem is concurrently eliminated by the above-described tabular silver halide emulsion. The tabular silver halide emulsion may also be used as a blue-sensitive emulsion by using an agent which spectrally sensitizes a blue region as described in Japanese Patent Application (OPI) No. 113926/83. However, application of spectrally sensitizing agents to tabular grain emulsions as suggested in Japanese Patent Application (OPI) No. 113926/83 cannot be called a special technique as has been asserted, and is not different from that applied to other ordinary silver halide grains at all.

SUMMARY OF THE INVENTION

Therefore, one object of the present invention pertains to a technique for spectrally sensitizing tabular silver halide grain-containing emulsions, and an important object of the present invention is to provide an extremely highly sensitive, spectrally sensitized silver halide photographic emulsion.

Another object of the present invention is to provide a silver halide photographic emulsion having high sensitivity in a color-sensitized region and low sensitivity in an intrinsically sensitive region, thus being adapted to color light-sensitive materials.

A further object of the present invention is to provide a spectrally sensitized silver halide photographic emulsion having high sensitivity when exposed with high illuminance.

As a result of various investigations, the inventors have successfully achieved the above-described objects by combining, in a silver halide emulsion in which tabular silver halide grains having a diameter-to-thickness ratio of 5 or more account for 50% or more of the whole silver halide grains by projected area, at least one cyanine dye represented by the following general formula (I) and at least one compound represented by the following general formula (II) and/or at least one compound represented by the following general formula (III).

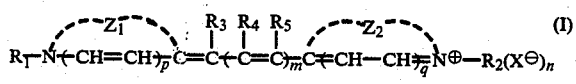

(I)

wherein $Z_1$ and $Z_2$ may be the same or different and each represents atoms necessary for forming a substituted or unsubstituted hetero ring, $R_1$ and $R_2$ may be the same or different and each represents a substituted or unsubstituted alkyl group, aryl group, alkenyl group or aralkyl group, with at least one of $R_1$ and $R_2$ being an alkyl group substituted by a carboxy or sulfo group, $R_3$ represents a hydrogen atom, $R_4$ and $R_5$ each represents a hydrogen atom, an alkyl group containing 4 or less carbon atoms, a phenethyl group or a phenyl group, or, $R_1$ and $R_3$, $R_2$ and $R_5$, $R_4$ and $R_4$ (when m=2), or $R_5$ and $R_5$ (when m=2) may be bonded to each other to represent atomic groups for completing an alkylene linkage to form a 5- or 6-membered ring, m represents 0, 1 or 2, p, q, and n each represents 0 or 1, and $X^{\ominus}$ represents an acid residue;

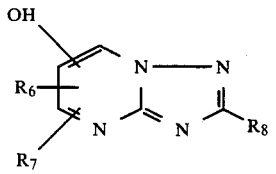

(II)

wherein $R_6$, $R_7$ and $R_8$ may be the same or different, and each represents a hydrogen atom, an alkoxycarbonyl group, a carboxyalkyl group, an acylamino group, an alkyl group or an aralkyl group, with $R_6$ and $R_7$ being optionally connected to each other to form a trimethylene or tetramethylene group; and

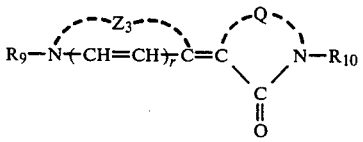

(III)

wherein $Z_3$ represents atoms necessary for forming a hetero ring,

Q represents atoms necessary for forming a rhodanine nucleus, a 2-thiohydantoin nucleus, a 2-thioselenazolidine-2,4-dione nucleus, or a 2-thiooxazolidine-2,4-dione nucleus, $R_9$ and $R_{10}$ each represents an alkyl group, an aryl group, an alkenyl group or an aralkyl group, and r represents 0 or 1.

DETAILED DESCRIPTION OF THE INVENTION

That is, it has now been found that the aforesaid dye desensitization of a tabular silver halide emulsion which is caused by an increased amount of the spectrally sensitizing agent is depressed by the present invention, whereby preferable properties expected of tabular silver halide grains are successfully obtained. It is believed that dye desensitization is caused by a reduction of latent image formation rather than by a decrease of the number of electrons produced by light. The present invention can overcome this reduction of latent image formation, thus providing high spectral sensitivity.

In addition, an increase in the amount of the added spectrally sensitizing agent generally tends to decrease high-illuminance sensitivity coupled with the aforesaid factors causing dye desensitization. It is also important to enhance high-illuminance sensitivity in effecting spectral sensitization and, as described in, for example, Japanese Patent Application (OPI) Nos. 28826/75, 73137/73, OLS-2063669, etc., various investigations have been made to enhance the sensitivity. However, the inventors of the present invention have concurrently enhanced this high-illuminance sensitivity in the technique of spectrally sensitizing tabular silver halide grains.

According to the present invention, the silver halide emulsion contains at least one cyanine dye represented by the general formula (I):

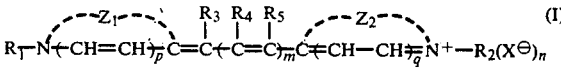

(I)

In the above general formula, atoms represented by $Z_1$ and $Z_2$, each forming a substituted or unsubstituted hetero ring, may be the same or different. Specific examples of $Z_1$ and $Z_2$ are atoms necessary for forming an oxazoline nucleus, an oxazole nucleus, a benzoxazole nucleus, a naphthoxazole nucleus (e.g., a naphtho[2,1-d]oxazole nucleus, a naptho[1,2-d]oxazole nucleus, a naphtho[2,3-d]oxazole nucleus, a 8,9-dihydronaphtho[1,2-d]oxazole nucleus, etc.), a thiazoline nucleus, a thiazole nucleus, a benzothiazole nucleus, a naphthothiazole nucleus (e.g., a naphtho[1,2-d]thiazole nucleus, a naphtho[2,1-d]thiazole nucleus, a naphtho[2,3-d]thiazole nucleus, an 8,9-dihydronaphtho[1,2-d]thiazole nucleus, etc.), a selenazoline nucleus, a selenazole nucleus, a benzoselenazole nucleus, a naphthoselenazole nucleus (e.g., a naphtho[1,2-d]selenazole nucleus, a naphtho[2,1-d]selenazole nucleus, a naphtho[2,3-d]selenazole nucleus, etc.), an imidazole nucleus, a benzimidazole nucleus, a naphthoimidazole nucleus (e.g., a naphtho[2,3-d]imidazole nucleus, a naphtho[1,2-d]imidazole nucleus, etc.), a pyridine nucleus or a quinoline nucleus.

The above-described nuclei may have one, two or more various substituents on the rings. Preferable examples of the substituents include a hydroxy group, a halogen atom (e.g., a fluorine atom, a chlorine atom, a bromine atom, etc.), an unsubstituted or substituted alkyl group (containing preferably 12 or less, more preferably 5 or less, total carbon atoms; e.g., a methyl group, an ethyl group, a propyl group, an isopropyl group, a decyl group, a dodecyl group, a hydroxyethyl group, a carboxymethyl group, an ethoxycarbonylmethyl group, a trifluoromethyl group, a chloroethyl group, a methoxymethyl group, etc.), an aryl group or a substituted aryl group (containing preferably 12 or less carbon atoms; e.g., a phenyl group, a tolyl group, an anisyl group, a chlorophenyl group, a 1-naphthyl group, a 2-naphthyl group, a carboxyphenyl group, a 2-thienyl group, a 2-furyl group, a 2-pyridyl group, etc.), an aralkyl group (containing preferably 10 or less carbon atoms; e.g., a benzyl group, a phenethyl group, a 2-furylmethyl group, etc.), an alkoxy group (containing preferably 10 or less carbon atoms, more preferably 5 or less carbon atoms; e.g., a methoxy group, an ethoxy group, a butoxy group, a decyloxy group, etc.), a carboxy group, an alkoxycarbonyl group (containing preferably 5 or less carbon atoms in the alkyl moiety; e.g., a methoxycarbonyl group, an ethoxycarbonyl group, a butoxycarbonyl group, etc.), an acylamino group (containing preferably 8 or less carbon atoms; e.g., an acetylamino group, a propionylamino group, a benzoylamino group, etc.), a methylenedioxy group, a tetramethylene group, a cyano group, an acyl group (containing preferably 8 or less carbon atoms; e.g., an acetyl group, a propionyl group, a benzoyl group, etc.), an alkylsulfonyl group (containing preferably 6 ot less carbon atoms; e.g., a methylsulfonyl group, an ethylsulfonyl group, etc.), an alkylsulfinyl group (containing preferably 6 ot less carbon atoms; e.g., a methylsulfinyl group, an ethylsulfinyl group, etc.), and the like.

$R_1$ and $R_2$ may be the same or different and each represents an alkyl group, an aryl group, an alkenyl group or an aralkyl group, which may be unsubstituted or substituted provided that at least one of them is substituted by a carboxy group or a sulfo group. These substituents have 20 or less carbon atoms, preferably 6 or less carbon atoms, in the alkyl or alkylene moiety, and have 15 or less carbon atoms in the aryl moiety (preferably phenyl, naphthyl or a derivative thereof).

Specific examples of $R_1$ and $R_2$ include a methyl group, an ethyl group, a propyl group, a butyl group, an isobutyl group, a pentyl group, a hexyl group, an octyl group, a dodecyl group, a 2-hydroxyethyl group, a 3-hydroxypropyl group, a 2-(2-hydroxyethoxy)ethyl group, a carboxymethyl group, a 2-carboxyethyl group, a 3-carboxypropyl group, an ethoxycarbonylmethyl group, a 2-sulfoethyl group, a 3-sulfopropyl group, a 3-sulfobutyl group, a 4-sulfobutyl group, a 2-hydroxy-3-sulfopropyl group, a 2-chloro-3-sulfopropyl group, a 2-(3-sulfopropyloxy)ethyl group, a 2-sulfatoethyl group, a 3-sulfatopropyl group, a 3-thiosulfatopropyl group, a 2-phosphonoethyl group, a 2-chloroethyl group, a 2,2,2-trifluoroethyl group, a 2,2,3,3-tetrafluoropropyl group, a 2-cyanoethyl group, a 3-cyanoethyl group, a 2-carbamoylethyl group, a 3-cabamoylpropyl group, a methoxyethyl group, an ethoxyethyl group, a methoxypropyl group, an allyl group, a phenyl group, a tolyl group, a chlorophenyl group, an anisyl group, a carboxyphenyl group, a sulfophenyl group, a naphthyl group, a sulfonaphthyl group, a benzyl group, a phenethyl group, a p-sulfophenethyl group, a m-sulfophenethyl group, a p-carboxypehenthyl group, etc.

$R_3$ represents a hydrogen atom.

$R_4$ and $R_5$ each represents a hydrogen atom, an alkyl group containing 4 or less carbon atoms, a phenethyl group or a phenyl group, or $R_1$ and $R_3$, $R_2$ and $R_5$, $R_4$ and $R_4$ (when m=2), or $R_5$ and $R_5$ (when m=2) may bound to each other to represent atomic groups necessary for completing alkylene bridge to form a 5- or 6-membered ring.

m represents 0, 1 or 2, p and q each represents 0 or 1, n represents 0 or 1, and $X^{\ominus}$ represents an acid residue.

According to the present invention, the silver halide emulsion also can contain at least one compound, represented by the General formula (II):

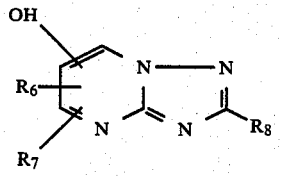

(II)

wherein $R_6$, $R_7$ and $R_8$ may be the same or different and each represents a hydrogen atom, an alkoxycarbonyl group containing 5 or less carbon atoms (e.g., an ethoxycarbonyl group, a butoxycarbonyl group, an isopropyloxycarbonyl group, etc.), a carboxyalkyl group containing 5 or less carbon atoms (e.g., a carboxymethyl group) an acylamino group containing 5 or less carbon atoms (e.g., an acetylamino group, a propionylamino group, an isovalerylamino group, etc.), an alkyl group containing 7 or less carbon atoms (e.g., a methyl group, an ethyl group, an isopropyl group, a heptyl group, etc.), an aralkyl group containing 10 or less total carbon atoms (e.g., a benzyl group, a phenethyl group, a 2-tolylethyl group, a 2-p-chloro-o-tolylethyl group, etc.), or $R_6$ and $R_7$ may be bound to each other to form a trimethylene or tetramethylene group.

Also according to the present invention, the silver halide emulsion can contain at least one compound represented by the general formula (III):

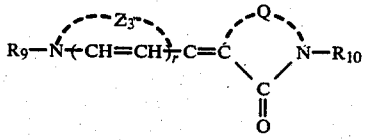

(III)

wherein $Z_3$ is the same as defined for $Z_1$ and $Z_2$ in the general formula (I) or atoms necessary for completing a pyrrolidine nucleus.

Q represents atoms necessary for forming a rhodanine nucleus, a 2-thiohydantoin nucleus, a 2-thioselenazolidine-2,4-dione nucleus or a 2-thiooxazolidine-2,4-dione nucleus. With the 2-thiohydantion nucleus, the nitrogen atom in the 1-position may be substituted by, preferably, an alkyl group (e.g., a methyl group, an ethyl group, a propyl group, a pentyl group, a decyl group, an isobutyl group, etc.), an alkoxyalkyl group (e.g., a methoxyethyl group, an ethoxyethyl group, a methoxypropyl group, etc.), a hydroxyalkyl group (e.g., a hydroxyethyl group, a 2-hydroxypropyl group, a 2,3-dihydroxypropyl group, etc.), a carboxyalkyl group (e.g., a carboxymethyl group), an alkoxycarbonylalkyl group (e.g., an ethoxycarbonylmethyl group), a hydroxyalkoxyalkyl group (e.g., a 2-(2-hydroxyethoxy)ethyl group), a hydroxyalkylaminocarbonylalkyl group (e.g., an N-(2-hydroxyamino)carbonylmethyl group), etc. These substituents contain, particularly preferably, 6 or less carbon atoms in the alkyl moiety thereof.

$R_9$ and $R_{10}$ each represents an alkyl group, an aryl group, an alkenyl group or an aralkyl group, which may be unsubstituted or substituted. These groups contain 10 or less, preferably 8 or less, carbon atoms in the alkyl and alkenyl moieties, 15 or less carbon atoms in the aryl moiety (preferably phenyl, naphthyl, pyridyl, furyl, thienyl or a derivative thereof), and 23 or less carbon groups in the aralkyl moiety in which the aryl moiety thereof contains 15 or less carbon atoms.

Specific examples of $R_9$ and $R_{10}$ include a methyl group, an ethyl group, a propyl group, a butyl group, an isopropyl group, a pentyl group, a hexyl group, an octyl group, a decyl group, a 2-hydroxyethyl group, a 3-hydroxypropyl group, a 2-(2-hydroxyethoxy)ethyl group, a carboxymethyl group, a 2-carboxyethyl group, a 3-carboxypropyl group, an ethoxycarbonylmethyl group, a 2-sulfoethyl group, a 3-sulfopropyl group, a 3-sulfobutyl group, a 4-sulfobutyl group, a 2-chloroethyl group, a 2,2,2-trifluoroethyl group, a 2,2,3,3-tetrafluoropropyl group, a 2-cyanoethyl group, a 3-cyanoethyl group, a 2-carbamoylethyl group, a methoxyethyl group, an ethoxyethyl group, a methoxypropyl group, an N-2-hydroxyaminocarbonylmethyl group, an allyl group, a cyclohexyl group, a cyclohexylmethyl group, a 2-furfurylmethyl group, a phenyl group, a tolyl group, a chlorophenyl group, an anisyl group, a carboxyphenyl group, a sulfophenyl group, a naphthyl group, a sulfonaphthyl group, a benzyl group, a phenethyl group, a p-sulfophenethyl group, a m-sulfophenethyl group, a p-carboxyphenethyl group, a 2-pyridyl group, a 3-pyridyl group, a 3-chloro-2-pyridyl group, a 2-furyl group, a 2-thienyl group, etc.

r represents 0 or 1.

The general formulae (I), (II), and (III) are described in more detail below.

In the general formula (I), preferable examples of the nuclei formed by $Z_1$ and $Z_2$ include an oxazoline nucleus, an oxazole nucleus, a benzoxazole nucleus, a naphthoxazole nucleus, a thiazoline nucleus, a thiazole nucleus, a benzothiazole nucleus, a naphthothiazole nucleus, a selenazoline nucleus, a selenazole nucleus, a benzoselenazole nucleus, a naphthoselenazole nucleus, a benzimidazole nucleus, a naphthoimidazole nucleus, and a quinoline nucleus, with an oxazole nuclues, a benzoxazole nucleus, a naphthoxazole nucleus, a thiazoline nucleus, a thiazole nucleus, a benzothiazole nucleus, a naphthothiazole nucleus, a selenazoline nucleus, a selenazole nucleus, a naphthoselenazole nucleus, and a benzimidazole nucleus being particularly preferable.

As substituents in the hetero ring nuclei containing a sulfur atom, an oxygen atom or a selenium atom, a hydroxy group, a chlorine atom, an unsubstituted alkyl group containing 1 to 5 carbon atoms, an alkoxyalkyl group containing 5 or less carbon atoms, an alkoxy group containing 5 or less carbon atoms, an alkoxycarbonyl group containing 5 or less carbon atoms, an acylamino group containing 3 or less carbon atoms, a phenyl group, a tolyl group, a chlorophenyl group and a carboxy group are preferable. In an imidazole nucleus, a chlorine atom, a fluorine atom, an alkylsulfonyl group containing 4 or less carbon atoms, an alkoxycarbonyl group containing 5 or less carbon atoms, an acyl group containing 5 or less carbon atoms, a cyano group, and a carboxy group are preferable as the substituents. With a pyridine nucleus, a quinoline nucleus, etc., a hydroxy group, a chlorine atom, a fluorine atom, an unsubstituted alkyl group containing 1 to 5 carbon atoms, and an alkoxy group containing 5 or less carbon atoms are preferable as the substituents.

As the substituent for $R_1$ and $R_2$ in the general formula (I), a hydroxy group, an alkoxy group, a chlorine atom, a fluorine atom, a carboxy group, a sulfo group, and a cyano group are preferable.

Of the compounds represented by the foregoing general formula (II), those represented by the following general formula (IV) are particularly preferable:

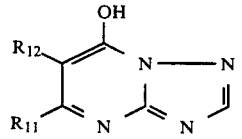

(IV)

wherein $R_{11}$ represents an alkyl group containing 7 or less carbon atoms, $R_{12}$ represents a hydrogen atom or an alkyl group containing 4 or less carbon atoms, provided that the sum of the carbon atoms in the alkyl group represented by $R_{11}$ and that in the alkyl group represented by $R_{12}$ is 7 or less, or $R_{11}$ and $R_{12}$ may be connected to each other to form a trimethylene or tetramethylene group.

Of the compounds represented by the foregoing general formula (III), those in which $Z_3$ forms a thiazoline nucleus, a thiazole nucleus, a benzothiazole nucleus, a naphthothiazole nucleus, a selenazoline nucleus, a selenazole nucleus, a benzoselenazole nucleus, a naphthoselenazole nucleus, an oxazole nucleus, a benzoxaole nucleus, a naphthoxazole nucleus, a pyrrolidine nucleus, or a benzimidazole nucleus and the sum of the carbon atoms contained in the substituent bound to the nitrogen atom of the hetero ring nucleus is 15 or less are preferable.

As $R_9$, an alkyl group and an aralkyl group are particularly preferable.

As the substituents for $R_9$ and $R_{10}$, a hydroxy group, an alkoxy group, a chlorine atom, a fluorine atom, a carboxy group, a sulfo group, and a cyano group are preferable.

In using the compounds represented by the general formula (III) for green-sensitive or red-sensitive emulsions for color light-sensitive materials or for silver halide emulsions for light-sensitive materials to be exposed to light rays emitted from a light source emitting light rays of longer wave-length region of 500 nm and longer such as a Ne-He laser, LED, etc., compounds of the general formula (III) having an absorption maximum wave-length of 430 nm or less in methanol are more preferable.

Typical specific examples of the compounds to be used in the present invention are illustrated below. Specific examples of the compounds of general formula (I):

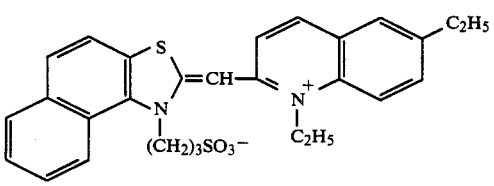

I-1

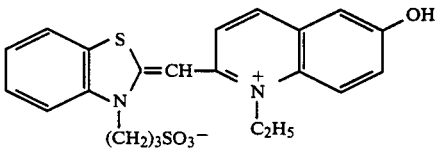

I-2

-continued
I-3
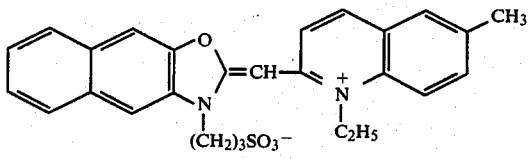
I-4
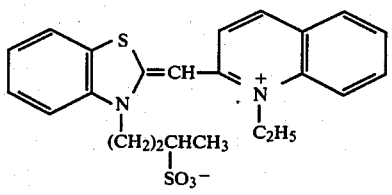
I-5
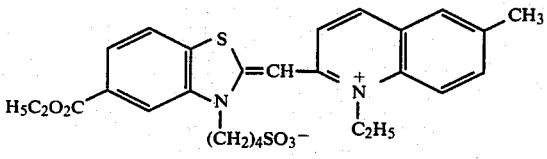
I-6
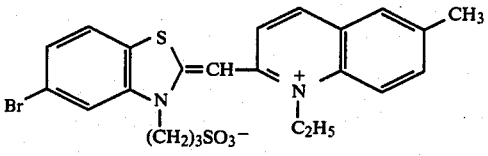
I-7
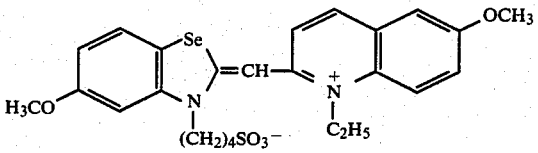
I-8
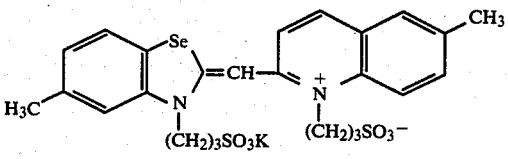
I-9
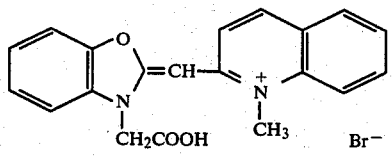
I-10
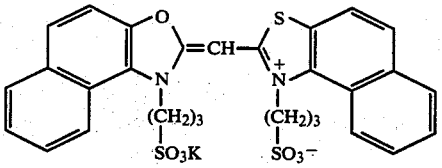
I-11
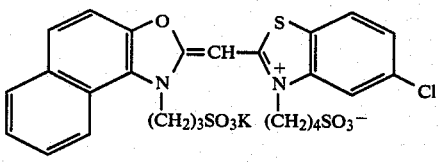
I-12
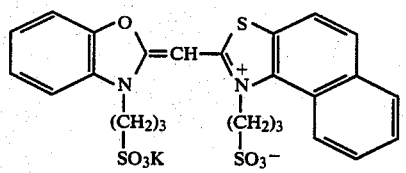
I-13
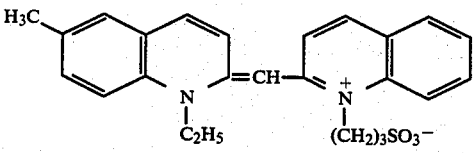
I-14
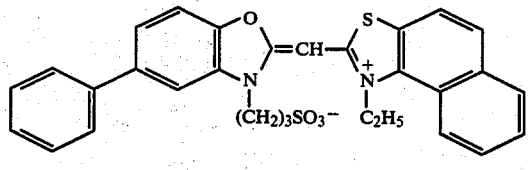
I-15
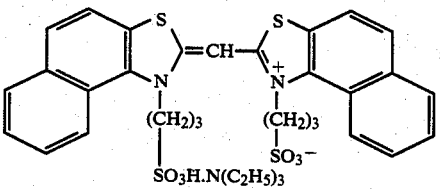
I-16
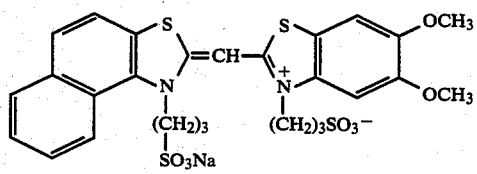

-continued
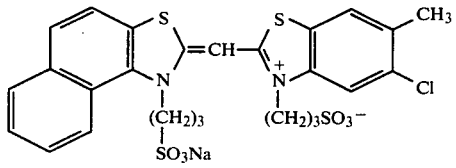
I-17
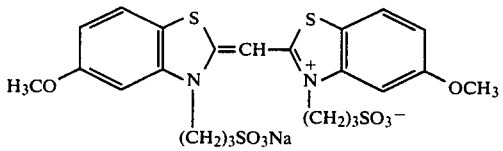
I-18
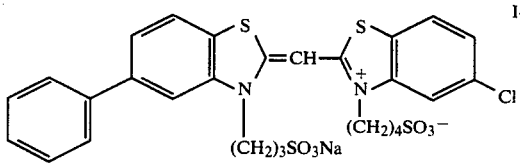
I-19
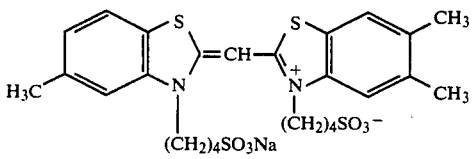
I-20
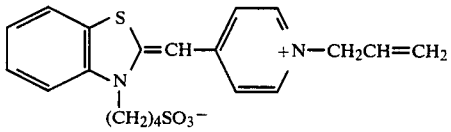
I-21
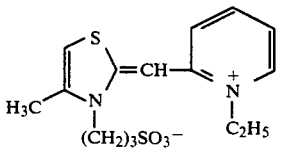
I-22
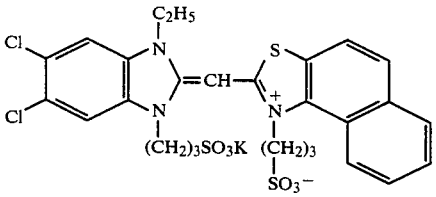
I-23
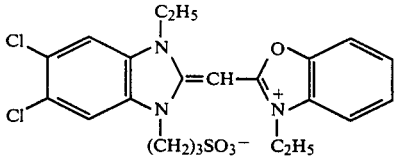
I-24
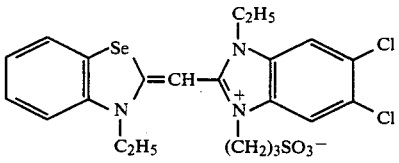
I-25
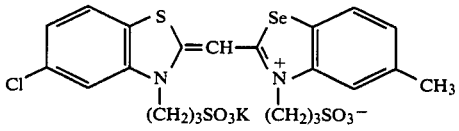
I-26
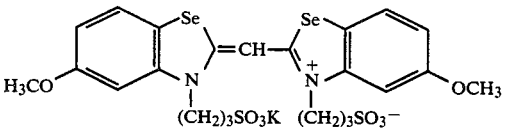
I-27
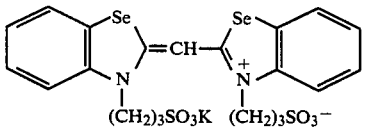
I-28
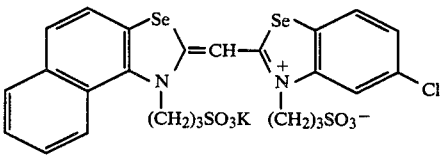
I-29
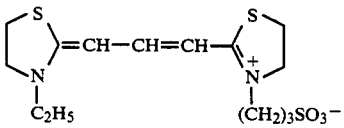
I-30

-continued
I-31
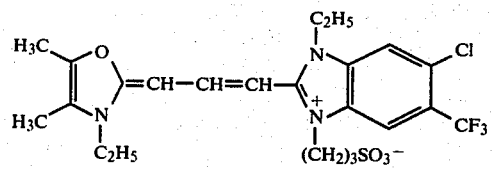
I-32
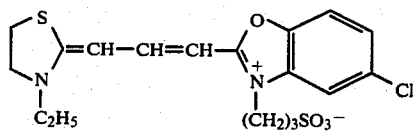
I-33
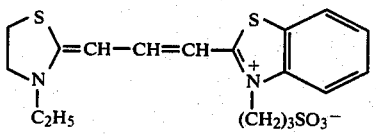
I-34
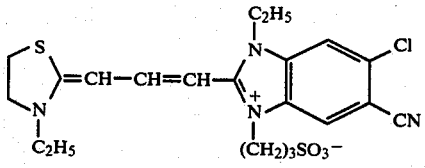
I-35
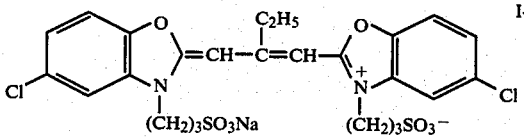
I-36
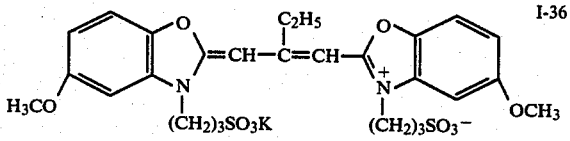
I-37
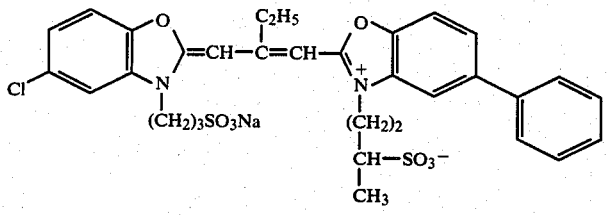
I-38
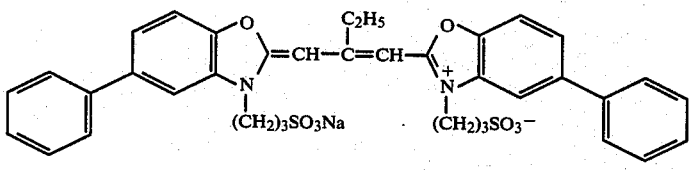
I-39
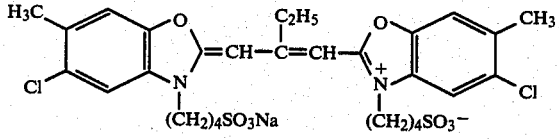
I-40
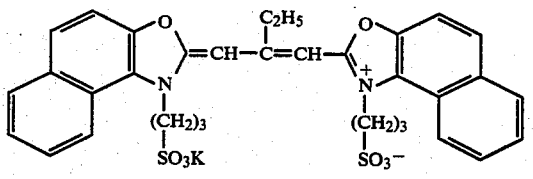
I-41
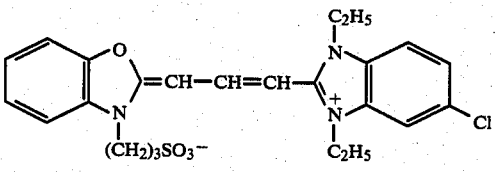
I-42
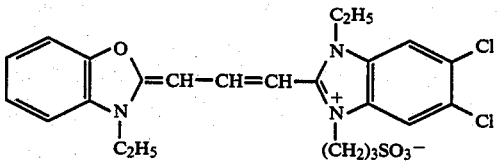

-continued
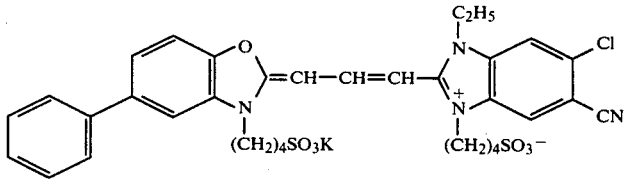
I-43
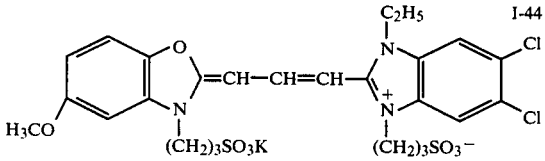
I-44
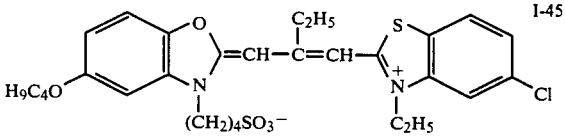
I-45
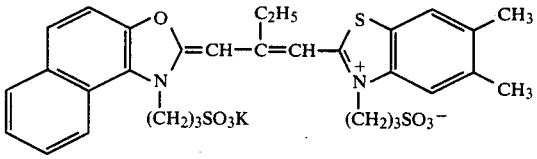
I-46
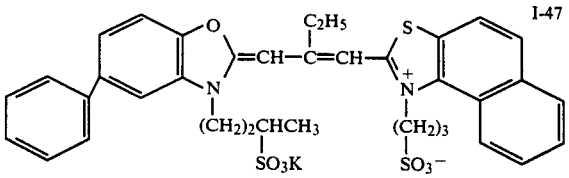
I-47
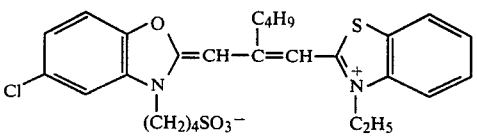
I-48
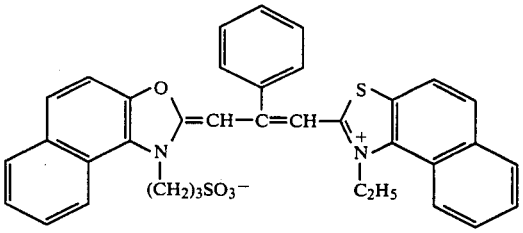
I-49
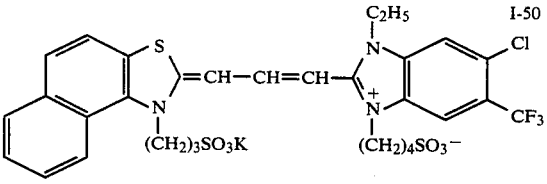
I-50
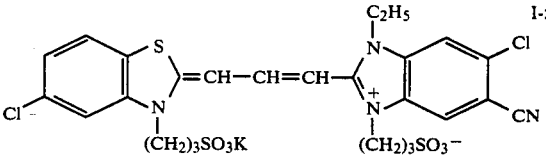
I-51
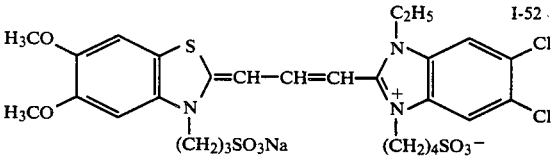
I-52
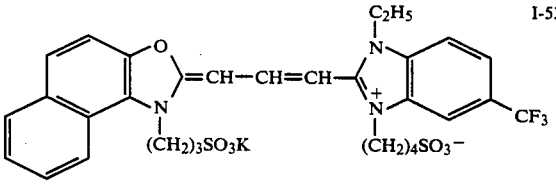
I-53
Specific examples of the compounds represented by the general formula (II):
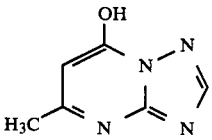
II-1
-continued
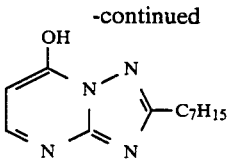
II-2

-continued
II-3
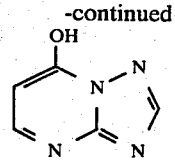
II-4
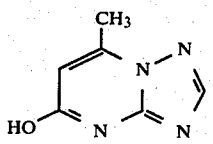
II-5
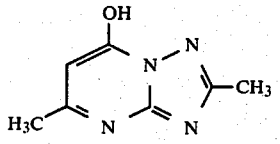
II-6
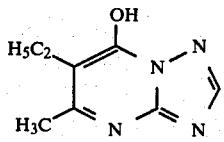
II-7
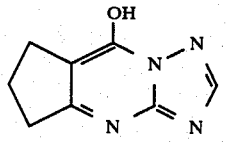
II-8
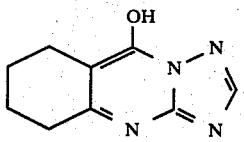
II-9
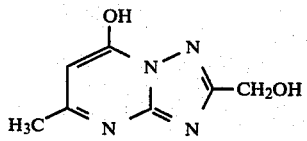
II-10
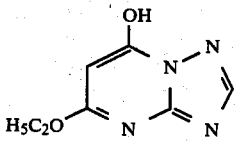
II-11
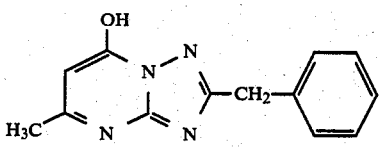
II-12
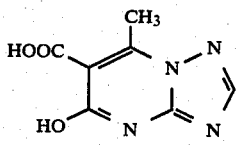
II-13
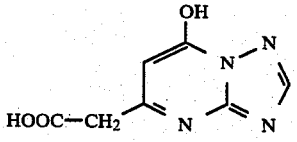
-continued
II-14
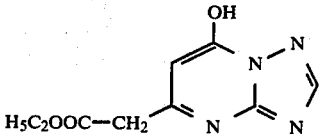
II-15
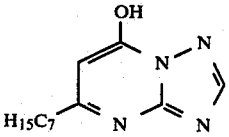
II-16
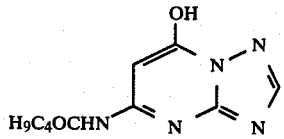
Specific examples of the compounds represented by the general formula (III):
III-1
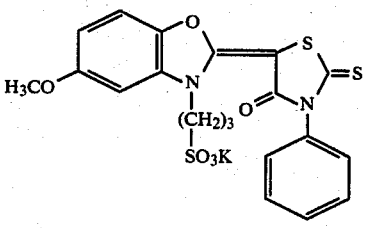
III-2
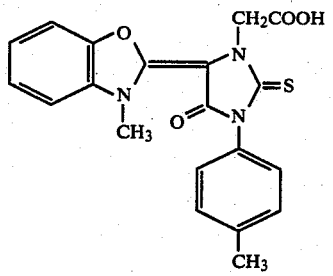
III-3
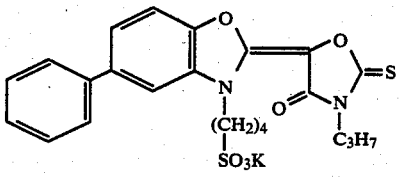
III-4
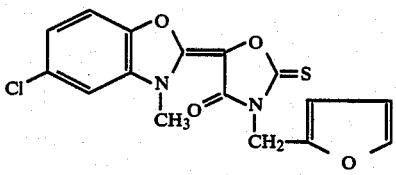
III-5
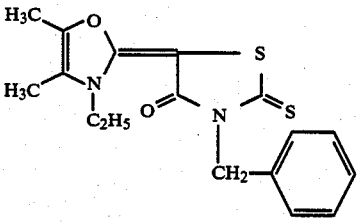

-continued
III-6
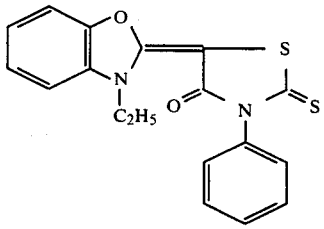
III-7
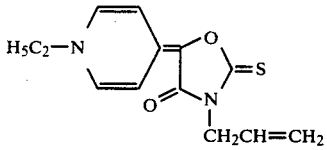
III-8
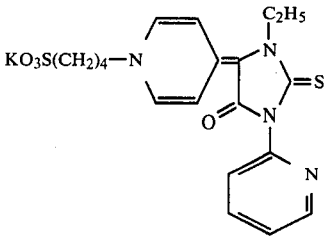
III-9
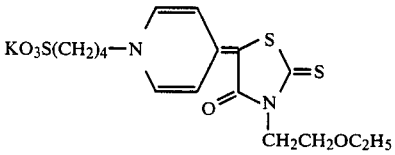
III-10
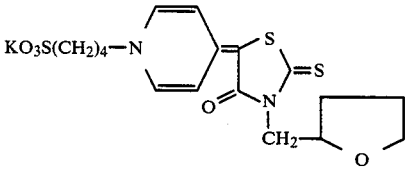
III-11
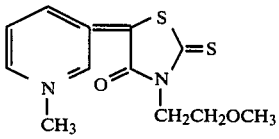
III-12
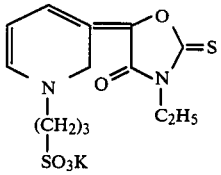
-continued
III-13
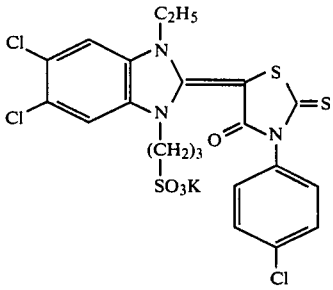
III-14
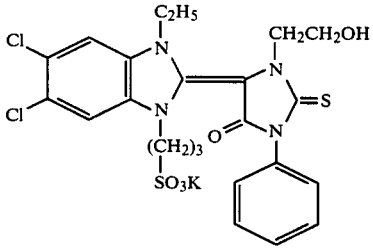
III-15
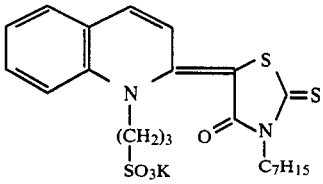
III-16
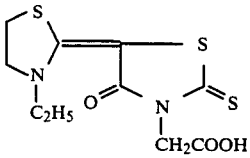
III-17
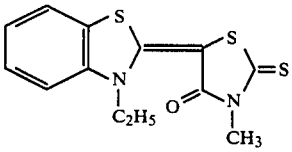
III-18
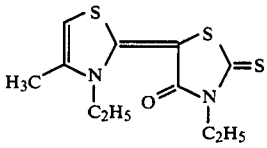
III-19
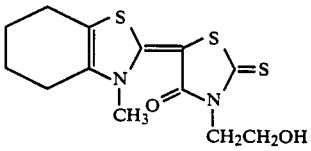
III-20
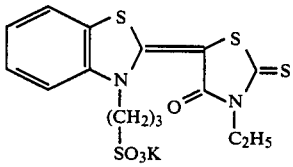

-continued
III-21
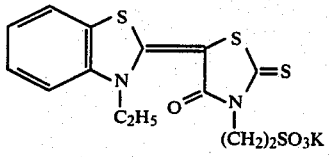
III-22
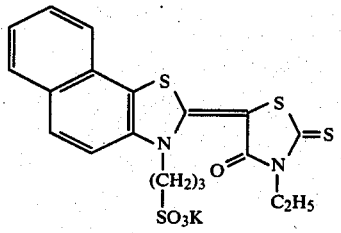
III-23
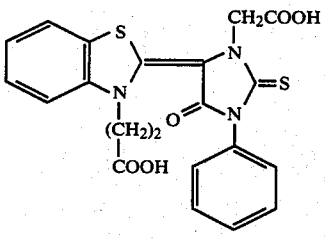
III-24
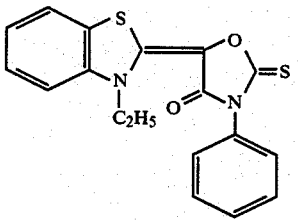
III-25
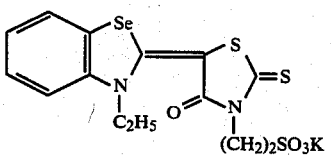
III-26
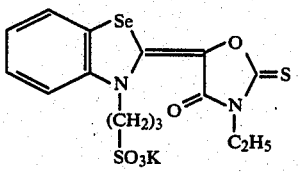
III-27
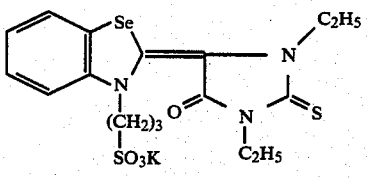
-continued
III-28
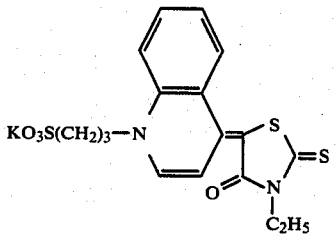
III-29
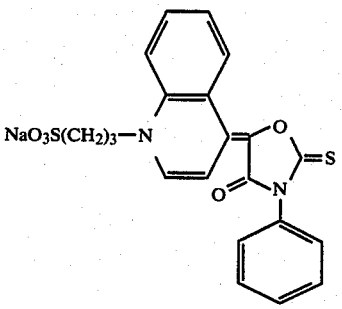
III-30
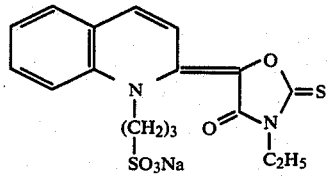
III-31
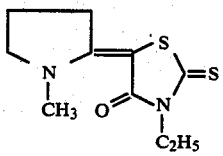
III-32
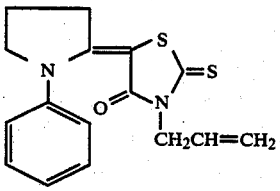
III-33
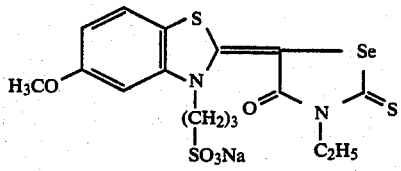
III-34
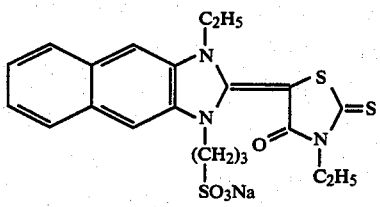
The compounds of the general formulae (I), (II), and (III) to be used in the present invention are known compounds.

For example, compounds represented by the general formulae (I) and (III) are described in the specifications of Japanese Patent Application (OPI) Nos. 126140/76, 139323/76, 14313/76, 35386/80, 109925/77, 135322/78, West German Patent OLS 2158553, Japanese Patent Publication No. 2614/77, F. M. Hamer, *The Chemistry of Heterocyclic Compounds,* Vol. 18, "The Cyanine Dyes and Related Compounds", A Weissberger ed., Interscience, New York, 1964, D. M. Sturmer, *The Chemistry of Heterocyclic Compounds,* Vol. 30, A. Weissberger and E. C. Taylor ed., John Wiley, New York, 1977, p.441, etc. and can be synthesized by referring to the descriptions therein. Compounds represented by the general formula (II) are described in, for example, Japanese Patent Application (OPI) Nos. 83714/78, 7723/76, 211142/82, 141027/78, 54936/82, etc. and can be easily synthesized by referring to Bülow, Haas, *Berichte,* Vol. 42, p.4638(1907), Allen et al., *J. Org. Chem.,* 24, 796 (1959), De Cat, Dormael, *Bull. Soc. Chem. Belg.,* 60, 69 (1951), Cook et al., *Rec. Trav. Chem.,* 69, 343 (1950)., etc.

In incorporating the compounds of the general formulae (I), (II) and (III) into a silver halide emulsion of the present invention, the compounds can be directly dispersed in the emulsion, or may be first dissolved in a sole or mixed solvent of water, methanol, ethanol, propanol, methyl cellosolve, 2,2,3,3-tetrafluoropropanol, etc., and then added to the emulsion. Further, the compounds may be added to the emulsion as an aqueous solution prepared in the copresence of an acid or a base as described in Japanese Patent Publication Nos. 23389/69, 27555/69, 22089/82, etc., or as an aqueous solution or a colloidal dispersion prepared in the copresence of a surfactant such as sodium dodecylbenzenesulfonate as described in U.S. Pat. Nos. 3,822,135, 4,006,025, etc. Still further, they may be first dissolved in a substantially water-immiscible solvent such as phenoxyethanol, dispersed in water or a hydrophilic colloid, then added to the emulsion, or they may be directly dispersed in a hydrophilic colloid, followed by adding the resulting dispersion to the emulsion as described in Japanese Patent Application (OPI) Nos. 102733/78 and 105141/83.

In adding these compounds to an emulsion, they may be added as a mixture or a single compound.

The addition is generally conducted before coating the emulsion on a suitable support, but may be conducted during chemical ripening, or during formation, of silver halide grains.

The amount of sensitizing dye represented by the general formula (I) may be in a range employed for conventional silver halide emulsions ($10^{-5}$ to $10^{-2}$ mol/mol silver) but, in order to obtain sufficient advantages of the present invention, the amount is preferably in a range of from 60 to 500%, more preferably 60 to 300%, of the saturated absorption amount of the dye, which causes dye desensitization with usual photographic techniques. On the other hand, with conventional silver halide emulsions including tabular silver halide grains, the amount of the compound to be added is in a range of not more than about 70% of the amount of saturated absorption on silver halide grains.

The compound of the general formula (II) to be used in combination with the compound of the general formula (I) is preferably used in an amount of 3 to 1,000 mols, more preferably 5 to 500 mols, per mol of the sensitizing dye of the general formula (I).

In the case of using the compound represented by the general formula (III) in combination with the compound of the general formula (I), it is used in an amount of 0.1 to 10 mols per mol of the compound of the general formula (I), with the sum of the amount of compound of the general formula (I) and the amount of compound of the general formula (III) to be added being in a range of from 70 to 500%, particularly preferably 80 to 300%, of the saturated absorption amount of the compound represented by the general formula (I) and the compound represented by the general formula (III).

The term "saturated absorption amount" as used herein means the maximum absorption amount of sensitizing dye necessary for completely covering the surface of whole silver halide grains with the sensitizing dye in a manner of single-layer absorption.

In the case of using the sensitizing dye represented by the general formula (I) in combination with the compound represented by the general formula (II) and the compound represented by the general formula (III), there results more enhanced sensitivity. Preferable amounts of these compounds are in the same ranges as set forth with respect to the combined use.

The compounds of the general formula (III) include those which spectrally sensitize even a blue-sensitive region. This is because, the compounds of the general formula (III) do not enhance the unnecessary blue-sensitive region much even when used in a red- or green-sensitive emulsion for color light-sensitive materials, since the sensitizing degree of the compounds of the general formula (III) is enough less than that of the compounds of the general formula (I). Of such compounds of the general formula (III), those which have the longest wavelength absorption maximum in methanol ($\lambda_{max}^{methanol}$) at 430 nm or less are preferably used, with those of 400 nm or less in $\lambda_{max}^{methanol}$ being more preferable.

The stage of adding the compounds (I), (II), and (III) to an emulsion is as set forth before and, as to the order of adding these compounds, the compounds represented by the general formula (I) and the general formula (II) are preferably added prior to the compound represented by the general formula (III) where they are added after the after-ripening step and before the coating step, with the sensitizing dye of the general formula (I) being preferably added simultaneously with, or prior to, the compound of the general formula (II).

Tabular silver halide grains to be used in the silver halide emulsion of the present invention have a diameter-to-thickness ratio of 5 or more, preferably 5 to 100, more preferably 5 to 50, most preferably 8 to 30. The proportion of such tabular silver halide grains in the whole silver halide grains in terms of projected area is 50% or more, preferably 70% or more, particularly preferably 85% or more. The use of such emulsion enables to obtain a silver halide photographic emulsion having high spectral sensitivity and excellent high-illuminance adaptability.

The diameters of tabular silver halide grains are in the range of from 0.5 to 10 μm, preferably 0.6 to 5.0 μm, more preferably 1 to 4 μm. The thicknesses of the grains are preferably 0.2 μm or less. The term "diameter" of tabular silver halide grain means a diameter of circle having the same area as the projected area of the grain, and "thickness" is presented as the distance between two parallel planes consituting the tabular silver halide grains.

In the present invention, more preferable tabular silver halide grains are not less than 0.6 μm and not more than 5.0 μm in diameter, not more than 0.2 μm in thickness, and not less than 5 and not more than 50 in average diameter-to-average thickness ratio. Still more preferably, tabular silver halide grains of 1.0 μm to 5.0 μm in diameter and 8 or more in diameter-to-thickness ratio account for 85% or more of the whole silver halide grains by projected area in a silver halide photographic emulsion.

The tabular silver halide grains may be any of silver chloride, silver bromide, silver chlorobromide, silver iodobromide, and silver chloroiodobromide, but silver bromide, silver iodobromide containing up to 12 mol% silver iodide, silver chloroiodobromide containing up to 50 mol% silver chloride and up to 2 mol% silver iodide, and silver chlorobromide are more preferable. Composition distribution in mixed silver halides may be uniform or localized, with uniform distribution being preferable. Grain size distribution may be narrow or broad.

Tabular silver halide emulsions are described in the report of Cugnac, Chateau and Duffin, *Photographic Emulsion Chemistry,* Focal Press, New York, 1966, pp.66–72, and A. P. H. Trivelli and W. F. Smith, *Phot. J.,* 80, 285 (1940), and may be readily prepared by referring to Japanese Patent Application (OPI) Nos. 127921/83, 113927/83, and 113928/83.

For example, tabular silver halide emulsions may be prepared by forming seed crystals, 40% or more by weight of which are tabular silver halide grains, in a surrounding of a comparatively high pAg of, for example, not more than 1.3 pBr and, while keeping the pBr value at about the same level, adding thereto a silver solution and a halide solution at the same time to grow the seed crystals.

During the grain-growing step, the silver solution and the halide solution are desirably added in such manner that no crystal nuclei are newly produced.

The sizes of tabular silver halide grains may be controlled by adjusting temperature, selecting kind and amount of the solvent, and controlling the rate of adding the silver salt and the halide.

Grain size, grain form (diameter-to-thickness ratio, etc.), grain size distribution, and the rate of grain growth may be controlled by using, if necessary, a silver halide solvent upon production of the tabular silver halide grains of the present invention. The amount of such solvent to be used preferably ranges from $10^{-3}$ to 1.0 wt%, particularly preferably from $10^{-2}$ to $10^{-1}$ wt%, of the reaction solution.

For example, the use of an increased amount of the solvent results in mono-disperse grain size distribution and accelerated grain growth. On the other hand, thickness of grain tends to increase with the increase in the amount of the solvent used.

As conventionally used silver halide solvents, there are illustrated ammonia, thioethers, thioureas, etc. As to thioethers, reference may be made to U.S. Pat. Nos. 3,271,157, 3,790,387, 3,574,628, etc.

During the step of formation or physical ripening of silver halide grains, cadmium salts, zinc salts, lead salts, thallium salts, iridium salts or complex salts thereof, rhodium salts or complex salts thereof, iron salts or complex salts thereof, etc. may be allowed to coexist.

In order to accelerate the rate of grain growth upon production of tabular silver halide grains of the present invention, the technique of increasing the adding rate and the added amount and concentration of the silver salt solution (for example, $AgNO_3$ aqueous solution) and the halide solution (for example, KBr aqueous solution) is preferably employed.

As to these techniques, reference may be made to British Pat. No. 1335925, U.S. Pat. Nos. 3,672,900, 3,650,757, 4,242,445, Japanese Patent Application (OPI) Nos. 142329/80, 158124/80, etc.

The tabular silver halide grains of the present invention may, if necessary, be chemically sensitized.

For conducting chemical sensitization, techniques described in, for example, H. Frieser, *Die Grundlagen der Photographishcen Prozesse mit Silberhalogeniden* (Akademische Verlagsgesellschaft, 1968), pp. 675–734 may be employed.

That is, sulfur sensitization using active gelatin or a sulfur-containing compound capable of reacting with silver (e.g., a thiosulfate, a thiourea, a mercapto compound, a rhodanine compound, etc.); reduction sensitization using a reductive substance (e.g., a stannous salt, an amine, a hydrazine derivative, formamidinesulfinic acid, a silane compound, etc.); noble metal sensitization using a noble metal compound (e.g., a gold complex salt or a complex salt of a group VII metal such as Pt, Ir or Pd); etc. may be used alone or in combination.

As to specific examples of these sensitization techniques, sulfur sensitization is described in U.S. Pat. Nos. 1,574,944, 2,410,689, 2,278,947, 2,728,668, 3,656,955, etc., reduction sensitization is described in U.S. Pat. Nos. 2,983,609, 2,419,974, 4,054,458, etc.; and noble metal sensitization is described in U.S. Pat. Nos. 2,399,083, and 2,448,060, British Patent No. 618061, etc.

From the viewpoint of saving silver, the tabular silver halide grains are preferably sensitized by the gold sensitization, sulfur sensitization, or the combination thereof.

Examples of preparing tabular silver halide emulsions in accordance with the present invention are described below. Unless otherwise specified, all ratios, percents, etc. are by weight.

PREPARATION EXAMPLE (1) 30 g of gelatin, 10.3 g of potassium bromide and 10 cc of a 0.5% aqueous solution of 3,6-dithiaoctane-1,8-diol were added to 1 liter of water and, while stirring the solution in a vessel kept at 70° C. (pAg 9.1; pH 6.5), 21.5 g of a 20.9% aqueous solution of silver nitrate and an aqueous solution prepared by adding 3.15 g of potassium bromide and 5 cc of a 5% aqueous solution of 3,6-dithiaoctane-1,8-diol to 16.7 cc of water were simultaneously added thereto in 15 seconds. Then, 956.5 g of a 14.55% aqueous solution of silver nitrate and 621.2 g of an aqueous solution prepared by adding 69.6 g of potassium bromide and 9.6 cc of a 5% aqueous solution of 3,6-dithiaoctane-1,8-diol to water were simultaneously added thereto in 65 minutes according to the double jet method. The thus obtained tabular silver halide grains had an average diameter of 0.83 μm and an average diameter/thickness ratio of 11.5, with grains having a diameter-to-thickness ratio of 10 or more accounting for 85% of the whole grains.

This emulsion was cooled to 35° C., and a flocculating agent was added thereto to flocculate, followed by washing with water. Then, a dispersing gelatin and water were added at 40° C. to adjust the pH and the pAg to 6.5 and 8.2, respectively. Sodium thiosulfate pentahydrate and potassium tetrachloroaurate were added thereto, and ripening of the emulsion was conducted at 60° C. to effect chemical sensitization, followed by adding thereto phenol as an antiseptic.

(2) 16.7 g of potassium bromide and 15 g of gelatin were added to 1 liter of water and, under well stirring, 16 cc of a 1.0 mol solution of silver nitrate and a 1.5 mol solution of potassium bromide were added thereto at a constant flow rate at a temperature of 65° C. and a pBr of 0.85 in two minutes according to the double jet method. After the addition, the system was maintained under the same condition for 30 seconds, then a 2.0 mol solution of silver nitrate was added thereto at 65° C. in about 7.5 minutes till pBr of the solution reached 1.23. (The amount of added silver nitrate solution was about 30 cc.) Subsequently, a 2.3 mol solution of potassium bromide and 149 cc of a 2.0 mol solution of silver nitrate were added thereto in 25.5 minutes at a temperature of 65° C. and at a pBr of 1.23 according to the double jet method with accelerating the adding rate so that the flow rate at the completion of the addition was about 5.6 times that at the start of the addition. Then, a silver nitrate aqueous solution of the same concentration was added thereto at a constant flow rate in about 6.5 minutes until the pAg was lowered to 8.15. (The amount of added silver nitrate aqueous solution was about 32 cc.) Then, again according to the double jet method, 281 cc of a silver nitrate aqueous solution of the same concentration and a 2.3 mol solution of potassium bromide were added thereto in 71.5 minutes at 65° C. at a constant flow rate while keeping the pAg at 8.15. After completion of precipitation, the system was cooled to 40° C., then 165 cc of a 15% solution of phthaloylated gelatin was added thereto. The resulting emulsion was washed according to the process described in U.S. Pat. No. 2,614,929, a dispersing gelatin, and water were added thereto at 40° C. to adjust the pH and the pAg of the system to 5.5 and 8.3, respectively. The thus obtained silver halide grains had an average diameter of 2.11 μm and an average thickness of 0.11 μm (i.e., diameter/thickness ratio being 19.2), with tabular grains having a diameter/thickness ratio of 12 or more accounting for 97.3% of the whole grains.

(3) 23.7 g of potassium bromide and 20 g of gelatin were added to 1 liter of water and, under well stirring, 1.0 liter of an aqueous solution of 118 g of potassium bromide and 1.0 liter of an aqueous solution of 118 g of silver nitrate were simultaneously added thereto in 90 minutes at 50° C. at a constant flow rate according to the double jet method (pAg: 10.77; pH: 5.04). After cooling to 35° C., the pH of the solution was adjusted to 4.0, and a flocculating agent was added thereto. After washing with water, 140 g of gelatin, 40 ml of a 5% aqueous solution of phenol, and water were added thereto at 40° C., and the resulting emulsion was adjusted to 6.5 in pH and 8.5 in pAg (total amount: 1.54 kg). The thus obtained tabular silver halide grains had an average diameter of 2.67 μm and an average thickness of 0.105 μm (therefore average diameter/thickness ratio being 25.4), with grains having a diameter/thickness ratio of 12 or more accounting for 80.2% of the whole grains in terms of projected area. Then, sodium thiosulfate pentahydrate was added to this emulsion to conduct chemical sensitization.

(4) 25.7 g of potassium bromide, 125 g of gelatin, and a 5% aqueous solution of 3,6-dithiaoctane-1,8-diol were added to 2.5 l of water and, under well stirring, 65 ml of a 12.77% aqueous solution of potassium bromide and 65 ml of a 17.22% aqueous solution of silver nitrate containing 0.4 g of ammonium sulfate were added thereto at 75° C. in 15 seconds at a constant flow rate according to the double jet method. After continuing the stirring for 20 minutes, 1.44 l of an aqueous solution of 246.2 g of potassium bromide, 10.5 g of potassium iodide, and 1.7 g of 3,6-dithiaoctane-1,8-diol and 1.44 l of a 20.90% aqueous solution of silver nitrate containing 9.0 g of ammonium nitrate were added thereto in 90 minutes according to the double jet method. (The amount of total silver nitrate added was 375.5 g.) Then, after cooling to 35° C., the system was adjusted to 4.10 in pH, and a flocculating agent was added thereto to flocculate silver halide, followed by washing with water. Then, 100 g of gelatin, 150 ml of a 5% aqueous solution of phenol, and 1.4 l of water were added thereto, and the resulting emulsion was adjusted to 6.8 in pH and 8.8 in pAg. Silver halide grains thus obtained had an average diameter of 1.78 μm and an average thickness of 0.12 μm (average diameter/thickness ratio: 14.8), with tabular silver halide grains having a diameter of 0.6 μm or more, a thickness of 0.2 μm or less, and a dimater-to-thickness ratio of 10 or more accounting for 97.8% of the whole grains by projected area. Then, sodium thiosulfate pentahydrate and potassium tetrachloroaurate were added thereto, and ripening was effected at 60° C.

(5) 11.9 g of potassium bromide and 8 g of gelatin were added to 1.0 liter of water and, under well stirring, 10 ml of a 1.2M solution of potassium bromide and 10 ml of a 1.2M solution of silver nitrate were added thereto at 65° C. in 5 minutes at the same flow rate according to the double jet method. Then, 0.07 liter of a 17.1% solution of phthaloylated gelatin was added thereto, followed by adding thereto 16.7 ml of a 1.2M solution of silver nitrate. Subsequently, a solution containing 1.06M potassium bromide and 0.14M potassium iodide and 0.39 liter of a 1.2M solution of silver nitrate were added thereto in 50 minutes according to the double jet method with accelerating the flow rate so that the final flow rate became two times the initial flow rate (pBr: 1.36). The system was cooled to 35° C., and a flocculating agent was added thereto, followed by washing with water. 85 g of gelatin, 0.6 liter of water, and 30 ml of a 5% phenol solution were added thereto, and the system was adjusted to 6.0 in pH and 8.3 in pAg. The thus obtained silver halide grains had an average diameter of 2.15 μm and an average thickness of 0.11 μm (average diameter/thickness ratio: 19.5), with tabular silver halide grains having a diameter-to-thickness ratio of 12 or more accounting for 87.2% of the whole grains by projected area.

To the photographic emulsion to be used in the present invention may be incorporated various compound for the purpose of preventing formation of fog or stabilizing photographic properties in the steps of producing, or during storage or processing of, light-sensitive materials. That is, many compounds known as antifoggants or stabilizers such as azoles (e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole, etc.); mercaptopyrimidines; mercaptotriazines, thioketo compounds such as oxazolinethione; azaindenes (e.g., triazaindenes, tetrazaindenes (particularly, 4-hydroxy-substituted (1,3,3a,7)tetrazaindenes, pentazaindenes, etc.); benzenethiosulfonic acids; benzenesulfinic acids; benzenesulfonic acid amides; etc. can be added.

As to more specific examples and the manner of using them, reference may be made to, for example, U.S. Pat.

Nos. 3,954,474, 3,982,947, Japanese Patent Publication No. 28660/77, etc.

The photographic light-sensitive material of the present invention may contain in its photographic emulsion layers or other hydrophilic colloidal layers various surfactants for various purposes such as improvement of coating properties, antistatic properties, slipping properties, emulsion dispersibility, anti-adhesion properties, and photographic properties (for example, development acceleration, realization of contrast tone, sensitization, etc.).

For example, there can be used nonionic surface active agents such as saponin (steroid type), alkylene oxide derivatives (e.g., polyethylene glycol, polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamines or amides, silicone polyethylene oxide adducts), glycidol derivatives (e.g., alkenylsuccinic acid polyglyceride, alkylphenol polyglyceride, etc.), polyhydric alcohol fatty acid esters, sugar alkyl esters, etc.; anionic surfactants having an acidic group such as a carboxy group, a sulfo group, a phospho group, a sulfuric ester group, or a phosphoric ester group (e.g., alkylcarboxylates, alkylsulfonates, alkylbenzenesulfonates, alkylnaphthalenesulfonates, alkylsulfuric esters, alkylphosphoric esters, N-acyl-N-alkyltaurines, sulfosuccinic esters, sulfoalkyl polyoxyethylene alkylphenyl ethers, polyoxyethylene alkylphosphoric esters, etc.; amphoteric surfactants such as amino acids, aminoalkylsulfonic acids, aminoalkylsulfuric or aminoalkylphosphoric esters, alkylbetaines, amine oxides, etc.; and cationic surfactants such as alkylamine satls, aliphatic or aromatic quaternary ammonium salts, hetero ring quaternary ammonium salts (e.g., pyridinium, imidazolium, etc.), aliphatic or hetero ring-containing phosphonium or sulfonium salts, etc.

The light-sensitive material of the present invention may contain in its photographic emulsion layer a polyethylene oxide or its ether, ester or amine derivative, a thioether compound, a thiomorpholine compound, a quaternary ammonium salt compound, an urethane derivative, a urea derivative, an imidazole derivative, a 3-pyrazolidone compound, etc. for the purpose of enhancing sensitivity or contrast or for accelerating development. For example, those described in U.S. Pat. Nos. 2,400,532, 2,423,549, 2,716,062, 3,617,280, 3,772,021, 3,808,003, British Pat. No. 1488991, etc. can be used.

The light-sensitive material to be used in the present invention may contain in its photographic emulsion layer or other hydrophilic collidal layers a water-insoluble or slightly water-soluble synthetic polymer dispersion for the purpose of improving dimensional stability or the like. For example, polymers containing as monomer components alkyl (meth)acrylates, alkoxyalkyl (meth)acrylates, glycidyl (meth)acrylates, (meth-)acrylamides, vinyl esters (e.g., vinyl acetate, etc.), acrylonitrile, olefins, styrene, or the like alone or in combination, or polymers containing as monomer components combiantions of the above-described monomers and acrylic acid, methacrylic acid, $\alpha,\beta$-unsaturated dicarboxylic acids, hydroxyalkyl (meth)acrylates, sulfoalkyl (meth)acrylates, styrenesulfonic acid, etc. may be used.

The present invention may also be applied to a multilayered, multi-color photographic material comprising a support having provided thereon at least two layers different from each other in spectral sensitivty. Multilayered, natural color photographic materials usually comprise a support having provided thereon at least one red-sensitive emulsion layer, at least one green-sensitive emulsion layer, and at least one blue-sensitive emulsion layer. The order of these layers may be optionally selected as the case demands. The red-sensitive emulsion layer usually contains a cyan-forming coupler, the green-sensitive emulsion layer a magenta-forming coupler, and the blue-sensitive emulsion layer a yellow-forming coupler. However, in some cases, different combinations may be employed.

In the present invention, the couplers may be used in combination with the following color image-forming couplers, i.e., compounds capable of forming color by oxidative coupling with an aromatic primary amine developing agent (for example, a phenylenediamine derivative, an aminophenol derivative, etc.) in color development processing. As the couplers, non-diffusible couplers having a hydrophobic group called ballast group or polymerized couplers are desirable. The couplers may be of either 4-equivalent type or 2-equivalent type to the silver ion. Colored couplers having a color-correcting effect or couplers capable of releasing a development inhibitor upon development (called DIR couplers) may also be incorporated. In addition, DIR coupling compounds capable of forming a colorless coupling reaction product and releasing a development inhibitor may also be incorporated.

For example, magenta couplers include 5-pyrazolone couplers, pyrazolobenzimidazole couplers, cyanoacetylcoumarone couplers, open-chain acylacetonitrile couplers, etc., yellow couplers include acylacetamide couplers (e.g., benzoylacetanilides, pivaloylacetanilides, etc.), etc., and cyan couplers include naphthol couplers, phenol couplers, etc.

The photographic color couplers to be used are conveniently selected so as to obtain intermediate-scale images. The maximum absorption band of a cyan dye formed from the cyan coupler preferably lies between about 600 and about 720 nm, the maximum absorption band of a magenta dye formed from the magenta coupler preferably lies between about 500 and about 580 nm, and the maximum absorption band of a yellow dye formed from the yellow coupler preferably lies between about 400 and about 480 nm.

The photographic light-sensitive material of the present invention may contain an organic or inorganic hardener in its photographic emulsion layers or other hydrophilic colloidal layers. For example, chromium salts e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), and the like can be used alone or in combination.

Where dyes or ultraviolet ray absorbents are incorporated in hydrophilic colloidal layers of a light-sensitive material prepared according to the present invention, they may be mordanted with cationic polymers or the like.

A light-sensitive material prepared according to the present invention may contain, as a color fog-preventing agent, a hydroquinone derivative, an aminophenol derivative, a gallic acid derivative, an ascorbic acid derivative, etc.

The light-sensitive material prepared according to the present invention may contain in its hydrophilic colloidal layer an ultraviolet ray absorbent. For example, aryl group-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in Japanese Patent Appliciation (OPI) No. 2784/71), cinnamic esters (e.g., those described in U.S. Pat. Nos. 3,705,805 and 3,707,375), butadiene compounds (e.g., those described in U.S. Pat. No. 4,045,229) or benzoccidol compounds (e.g., those described in U.S. Pat. No. 3,700,455) may be used. Further, those described in U.S. Pat. No. 3,499,762 and Japanese Patent Application (OPI) No. 48535/79 may also be used. UV ray-absorbing couplers (e.g., α-naphtholic, cyan dye-forming couplers) and UV ray-absorbing polymers may be used as well. These UV ray-absorbing agents may be mordanted to a specific layer.

The light-sensitive material prepared according to the present invention may contain in its hydrophilic layer a water-soluble dye as a filter dye or for various purposes such as prevention of irradiation. Such dye includes oxonol dyes, hemioxonol dyes, styryl dyes, merocyanine dyes, cyanine dyes, and azo dyes. Of these, oxonol dyes, hemioxonol dyes, and merocyanine dyes are particularly useful.

In the practice of the present invention, the following known fading-preventing agents can be used in combination. The color image-stabilizing agents to be used in the present invention may be used alone or in combination of two or more. The known fading-preventing agents include, for example, hydroquinone derivatives, gallic acid derivatives, p-alkoxyphenols, p-hydroxyphenol derivatives, and bisphenols.

Dyes which themselves do not have a spectrally sensitizing effect or substances which do not substantially absorb visible light and which show a supersensitizing effect may be incorporated together with the sensitizing dyes. For example, aminostilbene compounds (for example, those described in U.S. Pat. Nos. 2,933,390 and 3,635,721), aromatic organic acid-formaldehyde condensates (for example, those described in U.S. Pat. No. 3,743,510), cadmium salts, etc. may be incorporated.

Other various additives are used in the silver halide photographic emulsion of the present invention or light-sensitive materials using the emulsion. Such additives include, for example, brightening agents, spectrally sensitizing agents, desensitizing agents, matting agents, development accelerators, oils, mordants, UV ray absorbents, etc.

Specific examples of the aforesaid or these additives to be used are described in Research Disclosure, vol. 176, pp. 22–23 (RD-17643) (December, 1978), etc.

To the silver halide photographic emulsion to be used in the present invention may be added, as a protective colloid, acylated gelatin (e.g., phthaloylated gelatin or malonoylated gelatin) or a cellulose compound (e.g., hydroxyethyl cellulose or carboxymethyl cellulose) as well as gelatin; soluble starch (e.g., dextrin); hydrophilic polymer (e.g., polyvinyl alcohol, polyvinyl pyrrolidone, polyacrylamide, polystyrenesulfonic acid, etc.); a plasticizer for improving dimensional stability; latex polymer; and a matting agent. A finished emulsion is coated on a proper support.

As the support, any of transparent or opaque supports usually used for photographic elements, such as films composed of synthetic high polymers (e.g., polyalkyl (meth)acrylate, polystyrene, polyvinyl chloride, partially formalized polyvinyl alcohol, polycarbonate, polyesters such as polyethylene terephthalate, etc. or polyamides); films composed of cellulose derivatives (e.g., cellulose nitrate, cellulose acetate, cellulose acetate butyrate, etc.); paper and baryta-coated paper, α-olefin polymer-coated paper, synthetic paper composed of polystyrene or the like, may be used.

The present invention may be applied to sensitization of silver halide photographic emulsions for various color and black-and-white light-sensitive materials. Emulsions to be used include, for example, color positive-working emulsions, emulsions for color paper, color negative-working emulsions, color reversal emulsions (containing or not containing couplers), emulsions for photomechanical photographic light-sensitive materials (for example, so-called lith type light-sensitive materials), emulsions to be used in light-sensitive materials for cathode ray tube display, emulsions to be used in X ray-recording light-sensitive materials (particularly direct and indirect photography using a fluorescent screen), emulsions for use in silver salt diffusion transfer processes (described in, e.g., U.S. Pat. Nos. 2,543,181, 3,020,155, 2,861,885, etc.), emulsion for use in color diffusion transfer process (described in U.S. Pat. Nos. 3,087,817, 3,185,567, 2,983,606, 3,258,915, 3,227,550, 3,272,551, 3,227,552, 3,415,644, 3,415,645, 3,415,646, etc.), emulsions for use in silver dye-bleaching process (described in Friedman, *History of Color Photography*, American Photographic Publishers Co., 1944, particularly chap. 24 and *British Journal of Photography*, vol. 111, pp. 308–309, Apr. 7, 1964, etc.), emulsions to be used in materials for recording a printout image (described in, for example, U.S. Pat. No. 2,369,449, Belg. Pat. No. 704255, etc.), emulsions to be used in direct print image light-sensitive materials (described in, for example, U.S. Pat. Nos. 3,033,682, 3,287,137, etc.), emulsions to be used in thermally developable light-sensitive materials (described in, for example, U.S. Pat. Nos. 3,152,904, 3,312,550, 3,148,122, British Pat. No. 1,110,046, etc.), and the like.

Photographic processing of the layer composed of the photographic emulsion of the present invention may be conducted by using any of the known processes and known processing solutions described in, for example, *Research Disclosure* 176, pp. 28–30 (RD-17643). Such processing may be a black-and-white photographic processing for forming a silver image (black-and-white processing) or a color photographic processing for forming a dye image (color photographic processing) depending upon the end-use. The processing temperature is usually selected between 18° and 50° C. However, temperatures lower than 18° C. or higher than 50° C. may be employed.

The developing solution for conducting black-and-white photographic processing can contain known developing agents. As the developing agents, dihydroxybenzenes (e.g., hydroquinone, etc.), 3-pyrazolidones (e.g., 1-phenyl-3-pyrazolidone, etc.), aminophenols (e.g., N-methyl-p-aminophenol, etc.), etc. may be used alone or in combination. Generally, the developing solution further contains known preservatives, alkali agents, pH buffers, antifogging agents, etc. and, if necessary, may further contain dissolving aids, toning agents, development accelerators, surfactants, defoaming agents, water-softening agents, hardeners, viscosity-imparting agents, etc.

So-called "lith-type" development processing may be applied to the photographic emulsion of the present invention. "Lith-type" development processing means a development processing of using usually a dihydroxybenzene as a developing agent and conducting development in an infectious manner at a low sulfite ion concentration for photographically reproducing line images or halftone dot images. (Detailed descriptions on this technique are given in Mason, *Photographic Processing Chemistry* (1966), pp. 163–165.)

As a special type of development processing, a developing agent may be incorporated in a light-sensitive material, for example, in an emulsion layer, the resulting light-sensitive material being processed in an alkaline aqueous solution to develop. Of the developing agents, hydrophobic ones can be incorporated in an emulsion according to various techniques described in *Research Disclosure,* 169 (RD-16928), U.S. Pat. No. 2,739,890, British Pat. No. 813253, West German Pat. No. 15447763, etc. Such development processing may be combined with stabilizing processing of a silver salt with a thiocyanate.

As a fixing solution, those which have the same formulation as are ordinarily employed can be used. As a fixing agent, organic sulfur compounds which are known to functions as fixing agents can be used as well as thiosulfates and thiocyanates. The fixing solution may contain a water-soluble aluminum salt as a hardener.

In forming dye images, ordinary processes can be applied. For example, there may be employed a negative-positive process (described in, for example, *Journal of the Society of Motion Picture and Television Engineers,* vol. 61 (1953), pp. 667–701); a color reversal process of forming a negative silver image by developing with a developing solution containing a black-and-white developing agent, conducting at least once uniform exposure or other proper fogging processing, and subsequently conducting color development to thereby obtain positive dye images; a silver dye-bleaching process of forming a silver image by developing a dye-containing photographic emulsion layer after imagewise exposure to thereby form a silver image, and bleaching the dye using the silver image as a bleaching catalyst; and the like.

A color developing solution generally comprises an alkaline aqueous solution containing a color-developing agent. As the color-developing agent, known primary aromatic amine developing agents such as phenylenediamines (e.g., 4-amino-N,N-diethylaniline, 3-methyl-4-amino-N,N-diethyl-aniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline, etc.) can be used.

In addition, those described in L. F. A. Mason, *Photographic Processing Chemistry,* (Focal Press, 1966), pp. 226–229, U.S. Pat. Nos. 2,193,015, 2,592,364, Japanese Patent Application (OPI) No. 64933/73, etc. can be used.

To the color developing solution may be further added, if necessary, a pH buffer, a development inhibitor, an antifogging agent and, if necessary, a water-softening agent, a preservative, an organic solvent, a development accelerator, a dye-forming coupler, a competitive coupler, a fogging agent, an auxiliary developing agent, a viscosity-imparting agent, and a polycarboxylic acid type chelating agent, etc.

Specific examples of these additives are described in *Research Disclosure* (RD-17643), U.S. Pat. No. 4,083,723, West German Patent Application (OLS) No. 2622950, etc.

Color-developed photographic emulsion layers are usually bleached. Bleaching may be conducted separately or simultaneously with fixing. As bleaching agents, compounds of polyvalent metals such as iron (III), cobalt (III), chromium (VI), copper (II), etc., peracids, quinones, nitroso compounds, etc. are used. For example, ferricyanides, bichromates, organic complex salts of iron (III) or cobalt (III) (for example, complex salts of aminopolycarboxylic acids (e.g., ethylenediaminetetraacetic acid, 1,3-diamino-2-propanol tetraacetic acid, etc.) or of organic acids (e.g., citric acid, tartaric acid, malic acid, etc.); persulfates; permanganates; nitrosophenol; etc. may be used. Of these, potassium ferricyanide, iron (III) sodium ethylenediaminetetraacetate, and iron (III) ammonium ethylenediaminetetraacetate are particularly useful. Iron (III)-ethylenediaminetetraacetic acid complex salts are useful in both an independent bleaching solution and a monobath bleach-fixing solution.

To a bleaching or bleach-fixing solution may be added various additives in addition to bleaching-accelerating agents described in U.S. Pat. Nos. 3,042,520, 3,241,966, Japanese Patent Publication Nos. 8506/70, 8836,70, etc., and thiol compounds described in Japanese Patent Application (OPI) No. 65732/78, etc.

The present invention will now be described in more detail by the following non-limiting examples of the preferred embodiments of the present invention.

EXAMPLE 1

1 kg portions of silver iodobromide emulsion prepared in the same manner as in the foregoing emulsion preparation example (4) were weighed in respective pots, and sensitizing dye (I), compound (II), and/or sensitizing dye (III) shown in Table 1 to 6 were added thereto and, after adding thereto a 1 wt% aqueous solution of sodium 2-hydroxy-4,6-dichlorotriazine, each emulsion was coated on a polyethylene terephthalate film support in a dry thickness of 5 $\mu$m to obtain photographic light-sensitive materials.

Each of the samples was subjected to optical wedge exposure for 1/50 second using a 256-lux light of 5,400° K. in color temperature. As optical wedges, three optical wedges were used: one being an optical wedge fitted with a red filter (transmitting light rays of longer than 600 nm in wavelength), another being an optical wedge fitted with a yellow filter (transmitting light rays of longer than 500 nm in wavelength), and the other being an optical wedge itself.

After the exposure, each sample was developed at 20° C. for 4 minutes using a developer of the following formulation, subjected to stopping and fixing steps, then washed with water to obtain strips having a black-and-white image. Each of the strips was subjected to measurement of density to determine sensitivity to red light (SR), sensitivity to yellow light (SY), sensitivity to white light (SW), and fog. Optical density of standard point used for determining the sensitivity was (fog+0.20).

| Formulation of developer: | |
|---|---|
| Water | 700 ml |
| Metol (p-methylaminophenol sulfate) | 2.2 g |
| Anhydrous sodium sulfite | 96.0 g |
| Hydroquinone | 8.8 g |
| Sodium carbonate (monhydrate) | 56.0 g |
| Potassium bromide | 5.0 g |
| Water to make | 1 liter |

The thus obtained values are shown in Tables 1 through 6 as relative values.

TABLE 1

| Test No. | Added Amount ($\times 10^{-4}$ mol/kg emulsion) | | | | | | SR | Fog | *1 |
|---|---|---|---|---|---|---|---|---|---|
| 1-1 | (I-62) | 2 | | | | | 100*2 | 0.11 | 33 |
| 1-2 | | 4 | | | | | 48 | 0.11 | 66 |
| 1-3 | | 8 | | | | | 4 | 0.10 | 125 |
| 1-4 | | 16 | | | | | — | 0.10 | 250 |
| 1-5 | (I-62) | 2 | (II-1) | 486 | | | 302 | 0.10 | |
| 1-6 | | 4 | | 486 | | | 500 | 0.10 | |
| 1-7 | | 8 | | 486 | | | 500 | 0.10 | |
| 1-8 | | 16 | | 486 | | | 427 | 0.10 | |
| 1-9 | | 4 | | 160 | | | 436 | 0.10 | |
| 1-10 | (I-62) | 4 | | | (III-31) | 2 | 107 | 0.11 | 88 |
| 1-11 | | 4 | | | | 4 | 155 | 0.11 | 110 |
| 1-12 | | 4 | | | | 8 | 120 | 0.11 | 154 |
| 1-13 | (I-62) | 4 | (II-1) | 160 | (III-31) | 2 | 512 | 0.11 | |
| 1-14 | | 4 | | 160 | | 4 | 536 | 0.11 | |
| 1-15 | | — | | — | (III-31) | 4 | — | 0.10 | |

*1: $\frac{\text{Amount of compound (I) and compound (II) added}}{\text{Saturated absorption amount thereof}} \times 100\ (\%)$

*2: Standard

TABLE 2

| Test No. | Added Amount ($\times 10^{-4}$ mol/kg emulsion) | | | | | | SR | Fog |
|---|---|---|---|---|---|---|---|---|
| 2-1 | (I-70) | 2 | | | | | 100* | 0.10 |
| 2-2 | | 4 | | | | | 60 | 0.10 |
| 2-3 | | 8 | | | | | 15 | 0.10 |
| 2-4 | (I-70) | 2 | (II-7) | 216 | | | 282 | 0.10 |
| 2-5 | | 4 | | 216 | | | 340 | 0.10 |
| 2-6 | | 8 | | 216 | | | 316 | 0.10 |
| 2-7 | (I-70) | 4 | | | (III-6) | 2 | 115 | 0.10 |
| 2-8 | | 4 | | | | 4 | 144 | 0.10 |
| 2-9 | (I-70) | 4 | (II-7) | 216 | (III-6) | 2 | 380 | 0.10 |
| 2-10 | | 4 | | 216 | | 4 | 390 | 0.10 |
| 2-11 | | — | | — | (III-6) | 4 | — | 0.10 |

*standard

TABLE 3

| Test No. | Added Amount ($\times 10^{-4}$ mol/kg emulsion) | | | SY | Fog |
|---|---|---|---|---|---|
| 3-1 | (I-56) | 2 | | 100* | 0.10 |
| 3-2 | | 4 | | 85 | 0.10 |
| 3-3 | | 8 | | 43 | 0.10 |
| 3-4 | (I-56) | 4 | (II-1) 54 | 130 | 0.10 |
| 3-5 | | 4 | 216 | 200 | 0.10 |
| 3-6 | | 4 | 324 | 240 | 0.10 |
| 3-7 | | 4 | 486 | 272 | 0.10 |

*standard

TABLE 4

| Test No. | Added Amount ($\times 10^{-4}$ mol/kg emulsion) | | | SY | Fog |
|---|---|---|---|---|---|
| 4-1 | (I-38) | 2 | | 100* | 0.10 |
| 4-2 | | 4 | | 62 | 0.10 |
| 4-3 | | 8 | | 56 | 0.13 |
| 4-4 | (I-38) | 8 | (II-14) 54 | 141 | 0.13 |
| 4-5 | | 8 | 216 | 246 | 0.13 |
| 4-6 | | 8 | 324 | 346 | 0.13 |

TABLE 4-continued

| Test No. | Added Amount ($\times 10^{-4}$ mol/kg emulsion) | | SY | Fog |
|---|---|---|---|---|
| 4-7 | 8 | 986 | 457 | 0.13 |

*standard

TABLE 5

| Test No. | Added Amount ($\times 10^{-4}$ mol/kg emulsion) | | | | SY | Fog |
|---|---|---|---|---|---|---|
| 5-1 | (I-44) | 2 | | | 100* | 0.10 |
| 5-2 | | 4 | | | 87 | 0.10 |
| 5-3 | | 8 | | | 72 | 0.12 |
| 5-4 | (I-44) | 4 | (III-18) | 2 | 182 | 0.10 |
| 5-5 | | 4 | | 4 | 224 | 0.10 |
| 5-6 | | 4 | | 8 | 230 | 0.10 |
| 5-7 | | — | (III-18) | 8 | — | 0.10 |

*standard

TABLE 6

| Test No. | Added Amount ($\times 10^{-4}$ mol/kg emulsion) | | | | SW | Fog |
|---|---|---|---|---|---|---|
| 6-1 | (I-18) | 2 | | | 96 | 0.08 |
| 6-2 | | 4 | | | 100* | 0.08 |
| 6-3 | | 8 | | | 68 | 0.08 |
| 6-4 | (I-18) | 4 | (II-10) | 160 | 152 | 0.08 |
| 6-5 | | 4 | | 274 | 186 | 0.08 |
| 6-6 | | 4 | | 486 | 195 | 0.08 |

*standard

EXAMPLE 2

An emulsion for comparison was prepared as follows according to U.S. Pat. Nos. 4,184,877 and 3,320,069, and coating, exposure, and development processing were conducted in the same manner as in Example 1. The results thus obtained are shown in Table 7 as relative values.

TABLE 7

| Test No. | Added Amount ($\times 10^{-4}$ mol/kg emulsion) | | | | | | SR | Fog | *1 |
|---|---|---|---|---|---|---|---|---|---|
| 7-1 | (I-62) | 1 | | | | | 96 | 0.06 | 46 |
| 7-2 | | 2 | | | | | 100*2 | 0.06 | 90 |
| 7-3 | | 4 | | | | | 23 | 0.07 | 167 |
| 7-4 | (I-62) | 1 | (II-1) | 486 | | | 102 | 0.06 | |
| 7-5 | | 2 | | 486 | | | 129 | 0.06 | |
| 7-6 | | 4 | | 486 | | | 96 | 0.08 | |
| 7-7 | (I-62) | 2 | | | (III-31) | 1 | 112 | 0.06 | |
| 7-8 | | 2 | | | | 2 | 85 | 0.06 | |
| 7-9 | | 2 | | | | 4 | 49 | 0.06 | |

*1: $\frac{\text{Amount of compound (I) and compound (II) added}}{\text{Saturated absorption amount thereof}} \times 100\ (\%)$

*2: standard

Preparation of comparative tabular silver halide emulsion:

6.5 g of potassium bromide, 1.2 g of potassium iodide, and 4.9 g of potassium thiocyanate were added to 1 liter of a 2% gelatin aqueous solution and, while stirring at 70° C., 0.4 liter of an aqueous solution containing 57.5 g of potassium bromide and 2.5 g of potassium iodide and 0.4 liter of an aqueous solution containing 85 g of silver nitrate were added thereto in 45 minutes at an equal flow rate according to the double jet method. After cooling to 35° C., the emulsion was flocculated and washed with water in the same manner as in the aforesaid preparation example (4). Then, gelatin, water, and phenol were added thereto, followed by adjusting the pH to 6.8 and the pAg to 8.7. The thus obtained silver halide grains had an average diameter of 1.64 μm and an average thickness of 0.47 μm (average diameter/thickness ratio: 3.49). Then, sodium thiosulfate pentahydrate and potassium tetrachloroaurate were added thereto to ripen at 60° C.

The relationship between an increase in the amount of thiacarbocyanine (I-62) and sensitivity is shown in Table 1. It is seen that the optimal added amount of the sensitizing dye is small for the saturated absorption amount, and serious desensitization results when the amount is increased to near, or more than, the saturated absorption amount of the dye. However, when compound (II-1) is used in combination, remarkable spectral sensitization can be attained without desensitization. The same applies to Tables 2 to 4 and 6. Combined use of sensitizing dye (III) provides the same effect as described above, which also applies to Tables 2 and 6, provided that the effect of sensitizing dye (III) is smaller than that of compound (II).

Further, as is apparent from Tables 1, 2, and 3, combined use of the sensitizing dye of the general formula (I), the compound of the general formula (II), and the sensitizing dye (III) more enhance the remarkable sensitizing effect obtained by the combined use of the compound of the genera formula (I) and the compound of the general formula (II). On the other hand, in Example 2 using the comparative emulsion, only a slight effect was obtained even by using the same sensitizing dyes and compounds as shown in Table 1 of Example 1. It is quite surprising that the remarkable sensitizing effect as shown hereinbefore can be obtained even using emulsions of the same halide composition only by controlling the grain diameter-to-thickness ratio to a limited range.

EXAMPLE 3

Coated samples were prepared using the same silver halide emulsion in the same manner as in Example 1. For examining dependence upon exposure time, these samples were subjected to optical wedge exposure using a sensitometer containing a light source of a xenon flash lamp for 1/100 second (light energy intensity: $2.0\times10^{-5}W/m^2$) or for 1/500,000 second (light energy intensity: $2.5\times10^{-6}W/m^2$). Development processing was conducted in the same manner as in Example 1. The results thus obtained are shown in Table 8.

TABLE 8

| Test No. | Added Amount ($\times 10^{-4}$ mol/kg emulsion) | | | | Sensitivity for 1/500,000-sec Exposure* |
|---|---|---|---|---|---|
| 8-1 | (I-62) | 8 | — | — | 47 |
| 8-2 | | 8 | (II-1) 486 | — | 107 |
| 8-3 | | 8 | — | (III-31) 4 | 98 |
| 8-4 | (I-62) | 8 | (II-1) 324 | — | 105 |
| 8-5 | | 8 | 324 | (III-18) 4 | 105 |
| 8-6 | (I-36) | 8 | — | — | 54 |
| 8-7 | | 8 | — | (III-11) 8 | 91 |
| 8-8 | (I-46) | 8 | — | — | 50 |
| 8-9 | | 8 | — | (III-20) 8 | 100 |
| 8-10 | (I-63) | 4 | — | — | 42 |
| 8-11 | | 4 | (II-7) 216 | — | 96 |
| 8-12 | (I-60) | 8 | — | — | 48 |
| 8-13 | | 8 | (II-15) 324 | — | 96 |
| 8-14 | (I-52) | 8 | — | — | 55 |
| 8-15 | | 8 | — | (III-7) 8 | 102 |

*presented as specific sensitivity taking the sensitivity obtained by 1/100-second exposure as 100

As is clear from Table 8, when the sensitizing dye and the compound of the present invention were applied to tabular grains, sufficient sensitivity was obtained by the flash exposure of 1/500,000 second without reduction in specific sensitivity.

EXAMPLE 4

80 g of 1-hydroxy-N-{γ-(2,4-di-tert-amylphenoxypropyl)}-2-naphthamide was completely dissolved in a mixed solution of 100 ml of tricresyl phosphate and 50 ml of ethyl acetate. Further, 2 g of sorbitan monolaurate was dissolved therein. This solution was added to 1 kg of 10 wt% gelatin to which can aqueous solution of 2.5 g of dodecylbenzenesulfonic acid had been added, followed by high-speed stirring and ultrasonic wave stirring to emulsify. Thus, an emulsion was obtained. 1 kg portions of the same emulsion as used in Example 1 were weighed in pots, and sensitizing dye (I), compound (II) and/or sensitizing dye (III) were added thereto as shown in Tables 10 to 12. To each emulsion was added 300 g of the above-described emulsion, and 10 ml of a 1 wt% aqueous solution of sodium salt of 1-hydroxy-3,5-dichlorotriazine was added thereto. Further, 10 ml of a 1 wt% aqueous solution of sodium dodecylbenzenesulfonate was added thereto and, after stirring, the emulsion was coated in a dry thickness of 5 μm on a polyethylene terephthalate film support, followed by coating thereon a protective layer mainly comprising gelatin in a dry thickness of 1 μm. After drying, there were obtained photographic light-sensitive materials. These samples were subjected to 1/50-second optical wedge exposure using a 128-lux light of 5,400° K. in color temperature through a yellow filter (transmitting light rays of longer than 500 nm in wavelength), then developed at 38° C. according to the following color negative development processing.

| | |
|---|---|
| 1. Color development | 3 min. & 15 sec. |
| 2. Bleaching | 6 min. & 30 sec. |
| 3. Washing with water | 3 min. & 15 sec. |
| 4. Fixing | 6 min. & 30 sec. |
| 5. Washing with water | 3 min. & 15 sec. |
| 6. Stabilizing | 3 min. & 15 sec. |

Formulations of processing solutions used in respective steps are as follows:

| | |
|---|---|
| Color developer: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—Ethyl-N—β-hydroxyethylamino)-2-methylaniline sulfate | 4.5 g |
| Water to make | 1 liter |
| Bleaching solution: | |
| Ammonium bromide | 160.0 g |
| Aqueous ammonia (28%) | 25.0 cc |
| Sodium iron ethylenediaminetetraacetate | 130.0 g |
| Glacial acetic acid | 14.0 cc |
| Water to make | 1 liter |
| Fixing solution: | |
| Sodium tetrapolyphosphate | 2.0 g |
| Sodium thiosulfite | 4.0 g |
| Ammonium thiosulfate (70%) | 175.0 cc |
| Sodium bisulfite | 4.6 g |
| Water to make | 1 liter |
| Stabilizing solution: | |
| Formalin | 8.0 cc |

-continued

| | |
|---|---|
| Water to make | 1 liter |

Densities of the thus obtained strips were measured to obtain relative sensitivities and cyan color fog values. Optical density of the standard point used for determining the sensitivities was (fog+0.2). The results thus obtained are tabulated in Tables 9 to 11 as relative values.

TABLE 9

| Test No. | Added Amount ($\times 10^{-4}$ mol/kg emulsion) | | SY | Cyan Fog |
|---|---|---|---|---|
| 9-1 | (I-40) 2 | | 100* | 0.20 |
| 9-2 | 4 | | 63 | 0.26 |
| 9-3 | 8 | | 59 | 0.35 |
| 9-4 | (I-40) 8 | (II-10) 162 | 363 | 0.22 |
| 9-5 | 8 | 270 | 398 | 0.25 |
| 9-6 | 8 | 486 | 467 | 0.26 |
| 9-7 | — | 486 | — | 0.19 |

*standard

TABLE 10

| Test No. | Added Amount ($\times 10^{-4}$ mol/kg emulsion) | | SY | Cyan Fog |
|---|---|---|---|---|
| 10-1 | (I-52) 2 | | 100* | 0.22 |
| 10-2 | 4 | | 72 | 0.24 |
| 10-3 | 8 | | 55 | 0.30 |
| 10-4 | (I-52) 4 | (III-6) 4 | 240 | 0.25 |
| 10-5 | 4 | 8 | 234 | 0.25 |
| 10-6 | — | 8 | — | 0.20 |

*standard

TABLE 11

| Test No. | Added Amount ($\times 10^{-4}$ mol/kg emulsion) | | | SY | Cyan Fog |
|---|---|---|---|---|---|
| 11-1 | (I-80) 4 | — | — | 100* | 0.20 |
| 11-2 | 4 | (II-1) 324 | — | 346 | 0.23 |
| 11-3 | 4 | 324 | (III-12) 4 | 372 | 0.23 |
| 11-4 | — | — | 4 | — | 0.20 |
| 11-5 | — | (II-1) 324 | — | — | 0.19 |

*standard

It is seen from Example 4 that the sensitizing effect of the present invention shown in Example 1 can be also attained in the case of using couplers and conducting color development processing.

EXAMPLE 5

On a polyethylene terephthalate film support was coated a black cooloidal silver dispersion in gelatin in a silver amount of 2.0 mg/100 cm$^2$ to provide an antihalation layer, then the following different layers were coated thereon in the following order.

First layer: red-sensitive silver halide emulsion layer

A layer formed by coating a red-sensitive silver iodobromide emulsion (silver halide emulsion having the same composition as that used in Example 1) containing $5.34\times10^{-4}$ mol of sensitizing dye (I-62) of the present invention per mol of silver, $0.67\times10^{-4}$ mol of compound (I-63) per mol of silver, $4.32\times10^{-2}$ mol of compound (II-I) per mol of silver, and $2.67\times10^{-4}$ mol of sensitizing dye (III-20) per mol of silver, in a silver amount of 30 mg/100 cm$^2$ and cyan coupler (C-1) in an amount of 6.8 mg/100 cm$^2$.

Second layer:

An interlayer mainly comprising gelatin.

Third layer: green-sensitive silver halide emulsion layer

A layer formed by coating a green-sensitive silver iodobromide emulsion (the same silver halide emulsion as used in the first layer) containing $4.27\times10^{-4}$ mol of sensitizing dye (I-37) of the present invention per mol of silver, $1.33\times10^{-4}$ mol of (I-55) per mol of silver, $3.24\times10^{-2}$ mol of compound (II-1) per mol of silver, and $2.67\times10^{-4}$ mol of sensitizing dye (III-20) per mol of silver in a silver amount of 25 mg/100 cm$^2$ and a magenta color coupler (C-2) in an amount of 5.3 mg/100 cm$^2$.

Fourth layer: yellow filter layer

A layer formed by coating a yellow collidal silver dispersion in gelatin in an amount of 1.0 mg/100 cm$^2$.

Fifth layer: blue-sensitive silver halide emulsion layer

A layer formed by coating a blue-sensitive silver halide emulsion (the same silver halide emulsion as used in the first layer) containing $8.0\times10^4$ mol of sensitizing dye (I-18) of the present invention per mol of silver and $5.04\times10^{-2}$ mol of compound (II-1) per mol of silver, in a silver amount of 20 mg/100 cm$^2$ and a yellow color coupler (C-3) in an amount of b 9.8 mg/100 cm$^2$.

Sixth layer:

A protective layer mainly comprising gelatin.

The couplers in the first, third, and fifth layers were used by dissolving in tricresyl phosphate and emulsifying and dispersing the resulting solutions in gelatin. To the second and fourth layers were added to an emulsion prepared by emulsifying and dispersing a solution of 2,5-di(2,4,4-trimethylpentyl-2)hydroquinone in tricresyl phosphate as a color mixing-preventing agent. Sodium dodecylbenzenesulfonate was added to the first to sixth layers as a coating aid, and 2,4-dichloro-6-hydroxy-1,3,5-triazine sodium salt to the first to sixth layers as a hardener.

EXAMPLE 6

A coated sample was prepared in the same manner as in Example 5 except for changing the first layer as follows.

A red-sensitive silver halide emulsion having the same composition as in Example 4 except for decreasing the amount of compound (II-1) to $0.72\times10^{-2}$ mol per mol of silver.

EXAMPLE 7

A red-sensitive silver iodobromide emulsion was prepared by using the same silver halide emulsion as used in Example 2 and incorporating $2.66\times10^{-4}$ mol of sensitizing dye (I-62) per mol of silver, $0.33\times10^{-4}$ mol of (I-63) per mol of silver, $4.32\times10^{-2}$ mol of compound (II-1) per mol of silver, and $1.36\times10^{-4}$ mol of sensitizing dye (III-20) per mol of silver. The coated silver amount of this emulsion, cyan color coupler, the amount of coupler used, and other layers were the same as in Example 5.

EXAMPLE 8

A coated sample was prepared in the same manner as in Example 7 except for changing the first layer as follows.

A red-sensitive silver halide emulsion having the same composition as in Example 7 except for decreasing the amount of compound (II-1) in the first layer to $0.72\times10^{-2}$ mol per mol of silver.

The thus obtained samples were subjected to optical wedge exposure for 1/50 second using a 128-lux light of 5,400° K. in color temperature, then developed at 38° C. according to the same development processing procedure as in Example 4. Densities of the strips were determined to obtain sensitivities and fog values of the samples. Optical density of the standard point used for determining the sensitivities was (fog+0.2). The results thus obtained are shown in Table 12.

TABLE 12

| | Yellow Color Formation | | Magenta Color Formation | | Cyan Color Formation | |
|---|---|---|---|---|---|---|
| | Sensitivity | Fog | Sensitivity | Fog | Sensitivity | Fog |
| Ex. 5 | $\bar{3}.35$ | 0.67 | $\bar{3}.63$ | 0.60 | $\bar{3}.84$ | 0.35 |
| Ex. 6 | $\bar{3}.34$ | 0.67 | $\bar{3}.61$ | 0.61 | $\bar{2}.16$ | 0.37 |
| Ex. 7 | $\bar{3}.38$ | 0.67 | $\bar{3}.66$ | 0.62 | $\bar{2}.30$ | 0.33 |
| Ex. 8 | $\bar{3}.38$ | 0.67 | $\bar{3}.64$ | 0.62 | $\bar{2}.32$ | 0.36 |

Sensitivities are presented as logarithms of exposure amounts necessary for obtaining a density of (fog+0.2).

As is clear from Table 12, the use of an increased amount of the compound of the general formula (II) brings about remarkable sensitization with the silver halide emulsion of the present invention, whereas samples of Examples 7 and 8 using comparative emulsions showed low sensitivities and underwent almost no increase in sensitivity even when the amount of the compound (II) was increased.

The results of Examples 1 through 8 show that silver halide emulsions containing tabular silver halide grains specified by the present invention exhibit excellent sensitization properties when used in combination with the sensitizing dyes and compounds of the present invention, thus providing highly sensitive light-sensitive materials. Couplers used in Examples 5, 6, 7, and 8:

(C-1): 1-Hydroxy-N-{γ-(2,4-di-tert-amylphenoxypropyl)}2-naphthamide (C-2): 1-(2,4,6-Trichlorophenyl)-3-{3-(2,4-di-tert-amylphenoxyacetamido)benzamido}-5-pyrazolone (C-3): α-Pivaloyl-α-(2,4-di-oxo-5,5'-dimethyl-3-oxazolidinyl)-2-chloro-5-{α-(2,4-di-tertamylphenoxy)butyramido}-acetanilide While the invention has been described in detail, and with reference to specific embodiments thereof, it will be apparent to one skilled in the art that various changers and modifications can be made therein without departing from the spirit and scope thereof.

What is claimed is:

1. A silver halide photographic emulsion in which tabular silver halide grains having a diameter-to-thickness ratio of 5 or more account for 50% or more of the whole silver halide grains in terms of projected area, said silver halide emulsion containing at least one cyanine dye represented by the following general formula (I) and at least one compound represented by the following general formula (III):

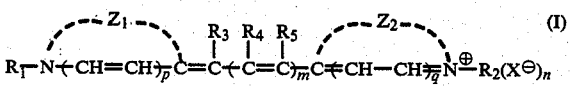

(I)

wherein $Z_1$ and $Z_2$ may be the same or different and, $Z_1$ is a group necessary for forming together with the group

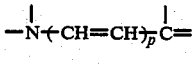

a substituted or unsubstituted hetero ring and $Z_2$ is a group necessary for forming together with the group

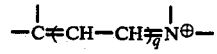

a substituted or unsubstituted hetero ring, $R_1$ and $R_2$ may be the same or different and each represents a substituted or unsubstituted alkyl group, aryl group, alkenyl group or aralkyl group, with at least one of $R_1$ and $R_2$ being an alkyl group substituted by a carboxy of sulfo group, $R_3$ represents a hydrogen atom, $R_4$ and $R_5$ each represents a hydrogen atom, an alkyl group containing 4 or less carbon atoms, a phenethyl group or a phenyl group, or, $R_1$ and $R_3$, $R_2$ and $R_5$, and $R_4$ (when m=2), or $R_5$ and $R_5$ (when m=2) may be bonded to each other to represent atomic groups for completing an alkylene linkage to form a 5- or 6-membered ring, m represents 0, 1 or 2, p, q, and n each represents 0 or 1, and $X^{\ominus}$ represents an acid residue anion; and

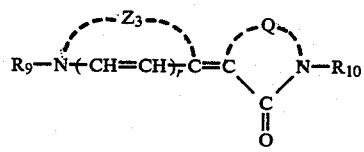

(III)

wherein $Z_3$ is a group necessary for forming together with the group

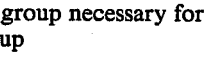

a hetero ring,

Q represents a group necessary for forming together with the group

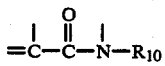

a rhodanine nucleus, a 2-thiohydantoin nucleus, a 2-thioselenazolidine-2,4-dione nucleus, or a 2-thiooxazolidine-2,4-dione nucleus, $R_9$ and $R_{10}$ each represents an alkyl group, an aryl group, an alkenyl group or an aralkyl group, and r represents 0 or 1.

2. A silver halide photographic emulsion as claimed in claim 1, wherein the hetero rings in the general formula (I) containing $Z_1$ and $Z_2$ are an oxazoline nucleus, an oxazole nucleus, a benzoxazole nucleus, a naphthoxazole nucleus, a thiazoline nucleus, a thiazole nucleus, a benzothiazole nucleus, a naphthothiazole nucleus, a selenazoline nucleus, a selenazole nucleus, a benzoselenazole nucleus, a naphthoselenazole nucleus, a benzimidazole nucleus, a naphthoimidazole nucleus, a pyridine nucleus or a quinoline nucleus.

3. A silver halide photographic emulsion as claimed in claim 2, wherein $Z_1$ and $Z_2$ in the general formula (I) are an oxazole nucleus, a benzoxazole nucleus, a naphthoxazole nucleus, a thiazoline nucleus, a thiazole nucleus, a benzothiazole nucleus, a naphthothiazole nucleus, a selenazoline nucleus, a selenazole nucleus, a naphthoselenazole nucleus, or a benzimidazole nucleus.

4. A silver halide photograhic emulsion as claimed in claim 2, wherein the substituents in a hetero ring nuclei containing a sulfur atom, an oxygen atom or a selenium atom represent a hydroxy group, a chlorine atom, an unsubstituted alkyl containing 1 to 5 carbon atoms, an alkoxyalkyl group containing 5 or less carbon atoms, an alkoxycarbonyl group containing 5 or less carbon atoms, an acylamino group containing 3 or less carbon atoms, a phenyl group, a tolyl group, a chlorophenyl group, or a carboxy group.

5. A silver halide photographic emulsion as claimed in claim 2, wherein the substituents in an imidazole nucleus containing $Z_1$ and $Z_2$ are a chlorine atom, a fluorine atom, an alkylsulfonyl group containing 4 or less carbon atoms, an alkoxycarbonyl group containing 5 or less carbon atoms, an acyl group containing 5 or less carbon atoms, a cyano group, or a carboxy group.

6. A silver halide photographic emulsion as claimed in claim 2, wherein the substituents in a pyridine nucleus or a quinoline nucleus containing $Z_1$ and $Z_2$ are a hydroxy group, a chlorine atom, a fluorine atom, an unsubstituted alkyl group containing 1 to 5 carbon atoms, or an alkoxy group containing 5 or less carbon atoms.

7. A silver halide photographic emulsion as claimed in claim 1, wherein $R_1$ and $R_2$ are substituted by a hydroxy group, an alkoxy group, a chlorine atom, a fluorine atom, a carboxy group, a sulfo group, or a cyano group.

8. A silver halide photographic emulsion as claimed in claim 1, wherein the compounds represented by the general formula (II) are those represented by the following general formula (IV):

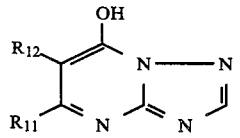

(IV)

wherein $R_{11}$ represents an alkyl group containing 7 or less carbon atoms, $R_{12}$ represents a hydrogen atom or an alkyl group containing 4 or less carbon atoms, provided that the sum of the carbon atoms in the alkyl group represented by $R_{11}$ and that in the alkyl group represented by $R_{12}$ is 7 or less, or $R_{11}$ and $R_{12}$ are connected to each other to form a trimethylene or tetramethylene group.

9. A silver halide photographic emulsion as claimed in claim 1, wherein the hetero ring of the general formula (III) containing $Z_3$ forms a thiazoline nucleus, a thiazole nucleus, a benzothiazole nucleus, a naphthothiazole nucleus, a selenazoline nucleus, a selenazole nucleus, a benzoselenazole nucleus, a naphthoselenazole nucleus, an oxazole nucleus, a benzoxazole nucleus, a naphthoxazole nucleus, a pyrrolidine nucleus or a benzimidazole nucleus and the sum of the carbon atoms contained in a substituent bound to the nitrogen atom of the hetero ring nucleus is 15 or less.

10. A silver halide photographic emulsion as claimed in claim 1, wherein $R_9$ is an alkyl group or an aralkyl group.

11. A silver halide photographic emulsion as claimed in claim 10, wherein $R_9$ and $R_{10}$ are substituted by a hydroxy group, an alkoxy group, a chlorine atom, a fluorine atom, a carboxy group, a sulfo group, or a cyano group.

12. A silver halide photographic emulsion as claimed in claim 1, wherein the amount of sensitizing dye represented by the general formula (I) is in a range of from 60 to 500% of the saturated absorption amount of the dye.

13. A silver halide photographic emulsion as claimed in claim 12, wherein the amount of sensitizing dye represented by the general formula (I) is in a range of from 60 to 300% of the saturated absorption amount of the dye.

14. A silver halide photographic emulsion as claimed in claim 1, wherein the amount of the compound of the general formula (II) to be used in combination with the compound of the general formula (I) is 3 to 1000 mols per mol of the sensitizing dye of the general formula (I).

15. A silver halide photographic emulsion as claimed in claim 14, wherein the amount of the compound of the general formula (II) to be used in combination with the compound of the general formula (I) is 5 to 500 mols per mol of the sensitizing dye of the general formula (I).

16. A silver halide photographic emulsion as claimed in claim 1, wherein the amount of the compound represented by the general formula (III) in combination with the compound of the general formula (I) is 0.1 to 10 mols per mol of the compound of the general formula (I) with the sum of the amount of compound of the general formula (I) and the amount of the compound of the general formula (III) to be added being in a range of from 70 to 500% of the saturated absorption amount of the compound of the general formula (I) and the compound of the general formula (III).

17. A silver halide photographic emulsion as claimed in claim 16, wherein the amount of the compound represented by the general formula (III) in combination with the compound of the general formula (I) is 0.1 to 10 mols per mol of the compound of the general formula (I) with the sum of the amount of compound of the general formula (I) and the amount of the compound of the general formula (III) to be added being in a range of from 80 to 300% of the saturated absorption amount of the compound of the general formula (I) and the compound of the general formula (III).

18. A silver halide photographic emulsion as claimed in claim 1, wherein the tabular silver halide grains have a diameter-to-thickness ratio of 5 to 100.

19. A silver halide photographic emulsion as claimed in claim 18, wherein the tabular silver halide grains have a diameter-to-thickness ratio of 5 to 50.

20. A silver halide photographic emulsion as claimed in claim 19, wherein the tabular silver halide grains have a diameter-to-thickness ratio of 8 to 30.

21. A silver halide photographic emulsion as claimed in claim 1, wherein the tabular silver halide grains account for 70% or more of the whole silver halide grains in terms of projected area.

22. A silver halide photographic emulsion as claimed in claim 21, wherein the tabular silver halide grains account for 85% or more of the whole silver halide grains in terms of projected area.

23. A silver halide photographic emulsion as claimed in claim 1, wherein the tabular silver halide grains are not less than 0.6 μm and not more than 5.0 μm in diameter, not more than 0.2 μm in thickness, and not less than 5 and not more than 50 in average diameter-to-average thickness ratio.

24. A silver halide photographic emulsion as claimed in claim 23, wherein the tabular silver halide grains are 1.0 μm to 5.0 μm in diameter and 8 or more in diameter-to-thickness ratio and account for 85% or more of the whole silver halide grains in terms of projected area.

25. A silver halide photographic emulsion as claimed in claim 1, wherein the tabular silver halide grains are silver bromide, silver iodobromide containing up to 12 mol% silver iodide, silver chloroiodobromide containing up to 50 mol% silver chloride and up to 2 mol% silver iodide, or silver chlorobromide.

26. A silver halide photographic emulsion as claimed in claim 1, wherein said silver halide emulsion contains at least at least one compound represented by the following general formula (II):

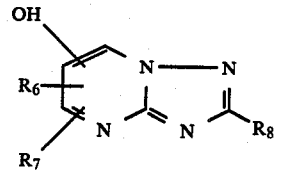

(II)

wherein $R_6$, $R_7$, and $R_8$ may be the same or different, and each represents a hydrogen atom, an alkoxycarbonyl group, a carboxyalkyl group, an acylamino group, an alkyl group or an aralkyl group, or $R_6$ and $R_7$ may be connected to each other to form a trimethylene or tetramethylene group.

* * * * *